US005664055A

United States Patent [19]

Kroon

[11] Patent Number: 5,664,055

[45] Date of Patent: Sep. 2, 1997

[54] CS-ACELP SPEECH COMPRESSION SYSTEM WITH ADAPTIVE PITCH PREDICTION FILTER GAIN BASED ON A MEASURE OF PERIODICITY

[75] Inventor: Peter Kroon, Green Grook, N.J.

[73] Assignee: Lucent Technologies Inc., Murray Hill, N.J.

[21] Appl. No.: 482,715

[22] Filed: Jun. 7, 1995

[51] Int. Cl.[6] ..... G10L 9/14

[52] U.S. Cl. ..... 704/223; 704/208; 704/219; 704/220; 704/222

[58] Field of Search ..... 395/2.16, 2.17, 395/2.28, 2.29, 2.3, 2.31, 2.32, 2.34, 2.33; 381/38, 40

[56] References Cited

PUBLICATIONS

Peter Noll, "Digital Audio Coding for Visual Communications", Proc. IEEE, vol. 83, No. 6, pp. 925–943, Jun. 1995.

Allen Gersho, "Advances in Speech and Audio Compression", Proc. IEEE, vol. 82, No. 6, pp. 900–918, Jun. 1994.

Schroeder et al, "Code-Excited Linear Prediction (CELP): High Quality Speech at Very Low Bit Rates," *Proc. ICASSP*, pp. 937–940, 1985.

Kleijn et al, "An Efficient Stochastically Excited Linear Predictive Coding Algorithm for High Quality Low Bit Rate Transmission of Speech," *Speech Communication*, vol. 7, No. 3, pp. 305–316, 1988.

Kroon et al, "On the Use of Pitch Predictors with High Temporal Resolution," *IEEE Trans Signal Proc.*, vol. 39, No. 3, pp. 733–735, 1991.

Tohkura et al., "Spectral smoothing Technique in PARCOR Speech Analysis–Synthesis," *IEEE Trans on ASSP*, vol. 26, No. 6, pp. 587–596, Dec. 1978.

Itakura, "Line Spectrum Representation of Linear Predictive Coefficients of Speech Signals", *J. Acoust. Soc. Amer.*, vol. 57, Suppl. No. 1, S35, 1975.

Soong et al., "Line Spectrum Pair (LSP) and Speech Data Compression," *Proc ICASSP*, pp. 1.10.1–1.10.4, 1984.

Kabal et al., "The Computation of Line Spectral Frequencies Using Chebyshev Polynomials," *IEEE Trans. on ASSP*, vol. 34, No. 6, pp. 1419–1426, Dec. 1986.

Paliwal et al, "Efficient Vector Quantization of LPC parameters at 24 bits/frame," *IEEE Trans. on Acoust. Speech and Signal Proc.*, Jan. 1993, pp. 3–14.

Laflamme et al., "16 kpbs Wideband Speech Coding Technique Based on Algebraic CElP," *Proc. ICASSP*, pp. 13–16.

*Primary Examiner*—Allen R. MacDonald
*Assistant Examiner*—Tálivaldis Ivais Smits
*Attorney, Agent, or Firm*—Thomas A. Restaino; Kenneth M. Brown

[57] ABSTRACT

A speech coding system employing an adaptive codebook model of periodicity is augmented with a pitch-predictive filter (PPF). This PPF has a delay equal to the integer component of the pitch-period and a gain which is adaptive based on a measure of periodicity of the speech signal. In accordance with an embodiment of the present invention, speech processing systems which include a first portion comprising an adaptive codebook and corresponding adaptive codebook amplifier and a second portion comprising a fixed codebook coupled to a pitch filter, are adapted to delay the adaptive codebook gain; determine the pitch filter gain based on the delayed adaptive codebook gain, and amplify samples of a signal in the pitch filter based on said determined pitch filter gain. The adaptive codebook gain is delayed for one subframe. The pitch filter gain equals the delayed, adaptive codebook gain, except when the adaptive codebook gain is either less than 0.2 or greater than 0.8., in which cases the pitch filter gain is set equal to 0.2 or 0.8, respectively.

19 Claims, 5 Drawing Sheets

CS-ACELP SPEECH COMPRESSION SYSTEM WITH ADAPTIVE PITCH PREDICTION FILTER GAIN BASED ON A MEASURE OF PERIODICITY

CROSS-REFERENCE TO RELATED APPLICATION

This application is related to Application Ser. No. 08/485,420, entitled "Codebook Gain Attenuation During Frame Erasure," filed on even date herewith, which is incorporated by reference as if set forth fully herein.

FIELD OF THE INVENTION

The present invention relates generally to adaptive codebook-based speech compression systems, and more particularly to such systems operating to compress speech having a pitch-period less than or equal to adaptive codebook vector (subframe) length.

BACKGROUND OF THE INVENTION

Many speech compression systems employ a subsystem to model the periodicity of a speech signal. Two such periodicity models in wide use in speech compression (or coding) systems are the pitch prediction filter (PPF) and the adaptive codebook (ACB).

The ACB is fundamentally a memory which stores samples of past speech signals, or derivatives thereof such as speech residual or excitation signals (hereafter speech signals). Periodicity is introduced (or modeled) by copying samples from the past (as stored in the memory) speech signal into the present to "predict" what the present speech signal will look like.

The PPF is a simple IIR filter which is typically of the form $$y(n)=x(n)+g_p y(n-M) \quad (1)$$

where n is a sample index, y is the output, x is the input, M is a delay value of the filter, and $g_p$ is a scale factor (or gain). Because the current outpbt of the PPF is dependent on a past output, is introduced the PPF.

Although either the ACB or PPF can be used in speech coding, these periodicity models do not operate identically under all circumstances. For example, while a PPF and an ACB will yield the same results when the pitch-period of voiced speech is greater than or equal to the subframe (or codebook vector) size, this is not the case if the pitch-period is less than the subframe size. This difference is illustrated by FIGS. 1 and 2, where it is assumed that the pitch-period (or delay) is 2.5 ms, but the subframe size is 5 ms.

FIG. 1 presents a conventional combination of a fixed codebook (FCB) and an ACB as used in a typical CELP speech compression system (this combination is used in both the encoder and decoder of the CELP system). As shown in the Figure, FCB 1 receives an index value, I, which causes the FCB to output a speech signal (excitation) vector of a predetermined duration. This duration is referred to as a subframe (here, 5 ms.). Illustratively, this speech excitation signal will consist of one or more main pulses located in the subframe. For purposes of clarity of presentation, the output vector will be assumed to have a single large pulse of unit magnitude. The output vector is scaled by a gain, $g_c$, applied by amplifier 5.

In parallel with the operation of the FCB 1 and gain 5, ACB 10 generates a speech signal based on previously synthesized speech. In a conventional fashion, the ACB 10 searches its memory of past speech for samples of speech which most closely match the original speech being coded. Such samples are in the neighborhood of one pitch-period (M) in the past from the present sample it is attempting to synthesize. Such past speech samples may not exist if the pitch is fractional; they may have to be synthesized by the ACB from surrounding speech sample values by linear interpolation, as is conventional. The ACB uses a past sample identified (or synthesized) in this way as the current sample. For clarity of explanation, the balance of this discussion will assume that the pitch-period is an integral multiple of the sample period and that past samples are identified by M for copying into the present subframe. The ACB outputs individual samples in this manner for the entire subframe (5 ms.). All samples produced by the ACB are scaled by a gain, $g_p$, applied by amplifier 15.

For current samples in the second half of the subframe, the "past" samples used as the "current" samples are those samples in the first half of the subframe. This is because the subframe is 5 ms in duration, but the pitch-period, M,—the time period used to identify past samples to use as current samples—is 2.5 ms. Therefore, if the current sample to be synthesized is at the 4 ms point in the subframe, the past sample of speech is at the 4 ms −2.5 ms or 1.5 ms point in the same subframe.

The output signals of the FCB and ACB amplifiers 5, 15 are summed at summing circuit 20 to yield an excitation signal for a conventional linear predictive (LPC) synthesis filter (not shown). A stylized representation of one subframe of this excitation signal produced by circuit 20 is also shown in FIG. 1. Assuming pulses of unit magnitudes before scaling, the system of codebooks yields several pulses in the 5 ms subframe. A first pulse of height $g_p$, a second pulse of height $g_c$, and a third pulse of height $g_p$. The third pulse is simply a copy of the first pulse created by the ACB. Note that there is no copy of the second pulse in the second half of the subframe since the ACB memory does not include the second pulse (and the fixed codebook has but one pulse per subframe).

FIG. 2 presents a periodicity model comprising a FCB 25 in series with a PPF 50. The PPF 50 comprises a summing circuit 45, a delay memory 35, and an amplifier 40. As with the system discussed above, an index, I, applied to the FCB 25 causes the FCB to output an excitation vector corresponding to the index. This vector has one major pulse. The vector is scaled by amplifier 30 which applies gain $g_c$. The scaled vector is then applied to the PPF 50. PPF 50 operates according to equation (1) above. A stylized representation of one subframe of PPF 50 output signal is also presented in FIG. 2. The first pulse of the PPF output subframe is the result of a delay, M, applied to a major pulse (assumed to have unit amplitude) from the previous subframe (not shown). The next pulse in the subframe is a pulse contained in the FCB output vector scaled by amplifier 30. Then, due to the delay 35 of 2.5 ms, these two pulses are repeated 2.5 ms later, respectively, scaled by amplifier 40.

There are major differences between the output signals of the ACB and PPF implementations of the periodicity model. They manifest themselves in the later half of the synthesized subframes depicted in FIGS. 1 and 2. First, the amplitudes of the third pulses are different—$g_p$ as compared with $g_p^2$. Second, there is no fourth pulse in output of the ACB model. Regarding this missing pulse, when the pitch-period is less than the frame size, the combination of an ACB and a FCB will not introduce a second fixed codebook contribution in the subframe. This is unlike the operation of a pitch prediction filter in series with a fixed codebook.

SUMMARY OF THE INVENTION

For those speech coding systems which employ an ACB model of periodicity, it has been proposed that a PPF be used at the output of the FCB. This PPF has a delay equal to the integer component of the pitch-period and a fixed gain of 0.8. The PPF does accomplish the insertion of the missing FCB pulse in the subframe, but with a gain value which is speculative. The reason the gain is speculative is that joint quantization of the ACB and FCB gains prevents the determination of an ACB gain for the current subframe until both ACB and FCB vectors have been determined.

The inventor of the present invention has recognized that the fixed-gain aspect of the pitch loop added to an ACB based synthesizer results in synthesized speech which is too periodic at times, resulting in an unnatural "buzzyness" of the synthesized speech.

The present invention solves a shortcoming of the proposed use of a PPF at the output of the FCB in systems which employ an ACB. The present invention provides a gain for the PPF which is not fixed, but adaptive based on a measure of periodicity of the speech signal. The adaptive PPF gain enhances PPF performance in that the gain is small when the speech signal is not very periodic and large when the speech signal is highly periodic. This adaptability avoids the "buzzyness" problem.

In accordance with an embodiment of the present invention, speech processing systems which include a first portion comprising an adaptive codebook and corresponding adaptive codebook amplifier and a second portion comprising a fixed codebook coupled to a pitch filter, are adapted to delay the adaptive codebook gain; determine the pitch filter gain based on the delayed adaptive codebook gain, and amplify samples of a signal in the pitch filter based on said determined pitch filter gain. The adaptive codebook gain is delayed for one subframe. The delayed gain is used since the quantized gain for the adaptive codebook is not available until the fixed codebook gain is determined. The pitch filter gain equals the delayed adaptive codebook gain, except when the adaptive codebook gain is either less than 0.2 or greater than 0.8, in which cases the pitch filter gain is set equal to 0.2 or 0.8, respectively. The limits are there to limit perceptually undesirable effects due to errors in estimating how periodic the excitation signal actually is.

DETAILED DESCRIPTION

I.1 Introduction to the Illustrative Embodiments

For clarity of explanation, the illustrative embodiments of the present invention is presented as comprising individual functional blocks (including functional blocks labeled as "processors"). The functions these blocks represent may be provided through the use of either shared or dedicated hardware, including, but not limited to, hardware capable of executing software. For example, the functions of processors presented in FIG. 3 and 4 may be provided by a single shared processor. (Use of the term "processor" should not be construed to refer exclusively to hardware capable of executing software.)

Illustrative embodiments may comprise digital signal processor (DSP) hardware, such as the AT&T DSP16 or DSP32C, read-only memory (ROM) for storing software performing the operations discussed below, and random access memory (RAM) for storing DSP results. Very large scale integration (VLSI) hardware embodiments, as well as custom VLSI circuitry in combination with a general purpose DSP circuit, may also be provided.

The embodiments described below are suitable for use in many speech compression systems such as, for example, that described in a preliminary Draft Recommendation G.729 to the ITU Standards Body (G.729 Draft), which is provided in Section II. This speech compression system operates at 8 kbit/s is based on Code-Excited Linear-Predictive (CELP) coding. See G.729 Draft Subsection II.2. This draft recommendation includes a complete description of the speech coding system, as well as the use of the present invention therein. See generally, for example, FIG. 6 and the discussion at Subsection II.2.1 of the G.729 Draft. With respect to the an embodiment of present invention, see the discussion at Subsections II.3.8 and II.4.1.2 of the G.729 Draft.

I.2: The Illustrative Embodiments

Figure 1:
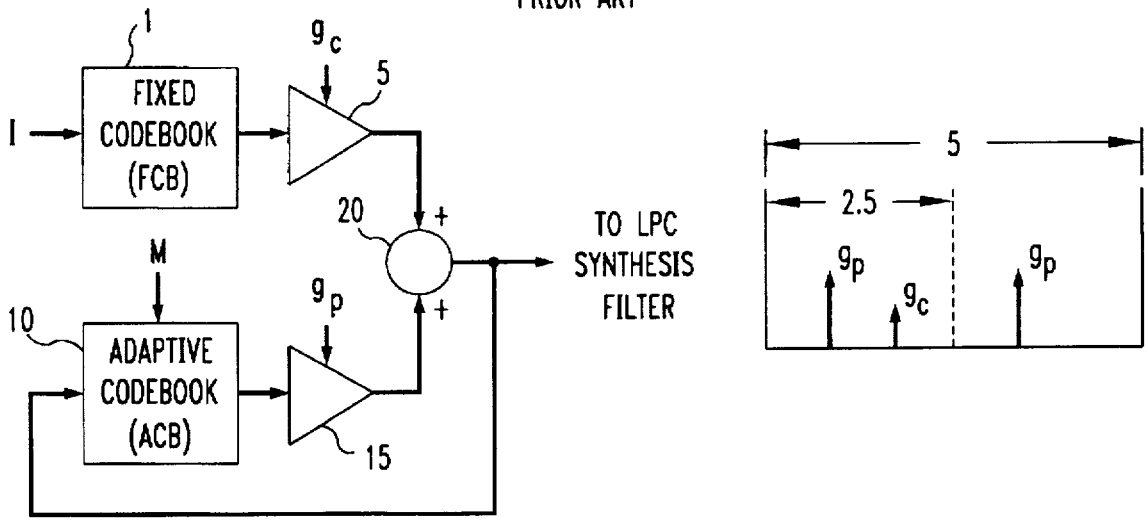
FIG. 1 PRIOR ART
FIG. 1 presents a conventional combination of FCB and ACB systems as used in a typical CELP speech compression system, as well as a stylized representation of one subframe of an excitation signal generated by the combination.
Figure 2:
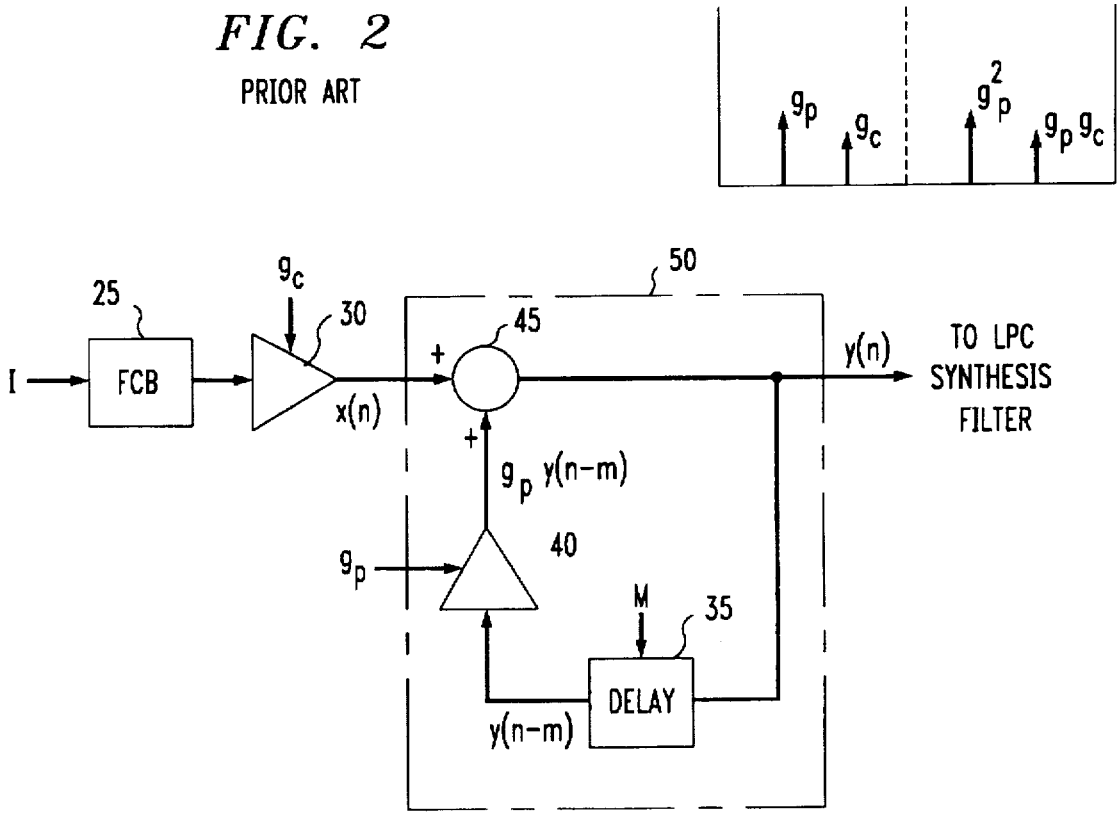
FIG. 2 PRIOR ART
FIG. 2 presents a periodicity model comprising a FCB and a PPF, as well as a stylized representation of one subframe of PPF output signal.
Figure 3:
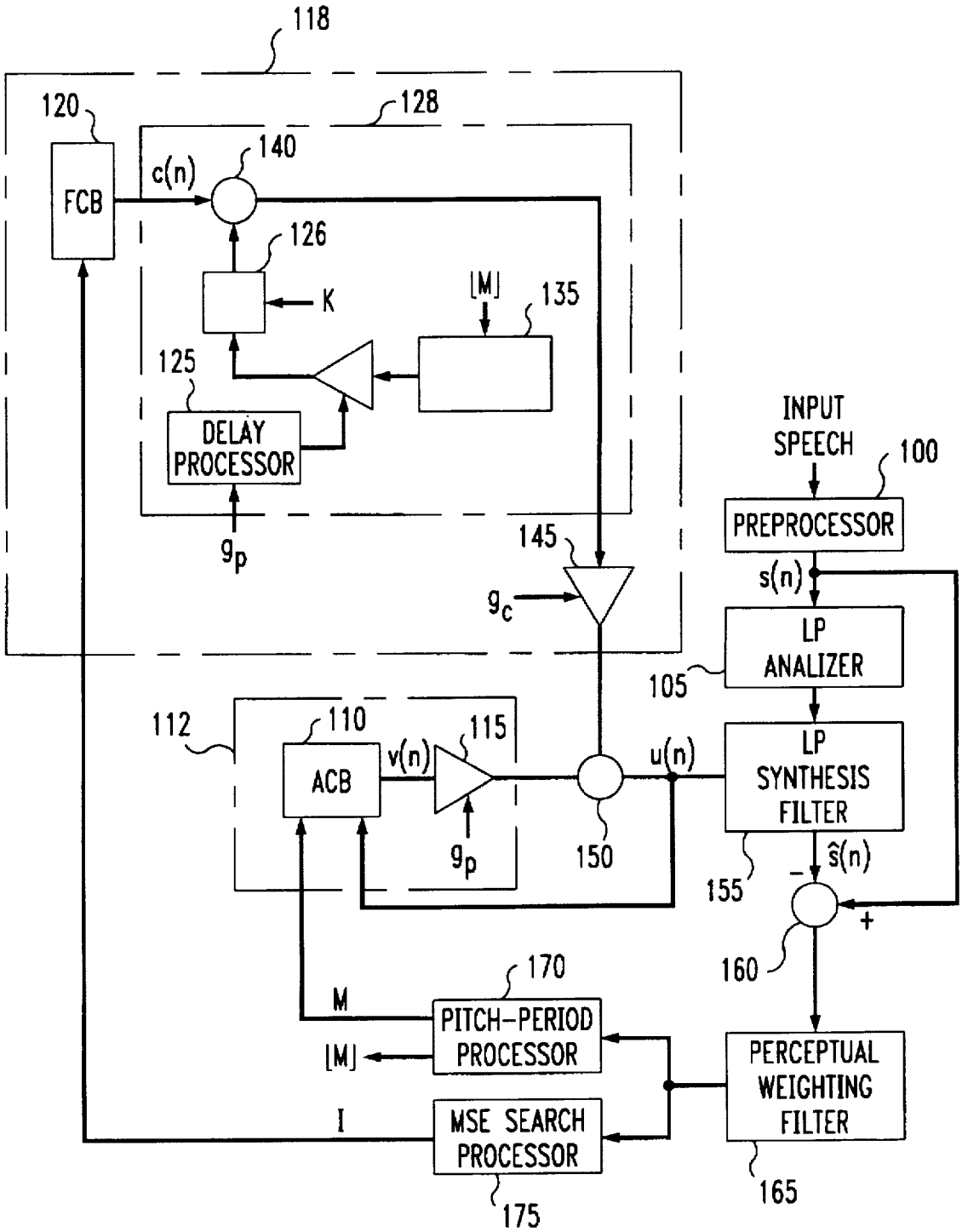
FIG. 3 presents an illustrative embodiment of a speech encoder in accordance with the present invention.
Figure 4:
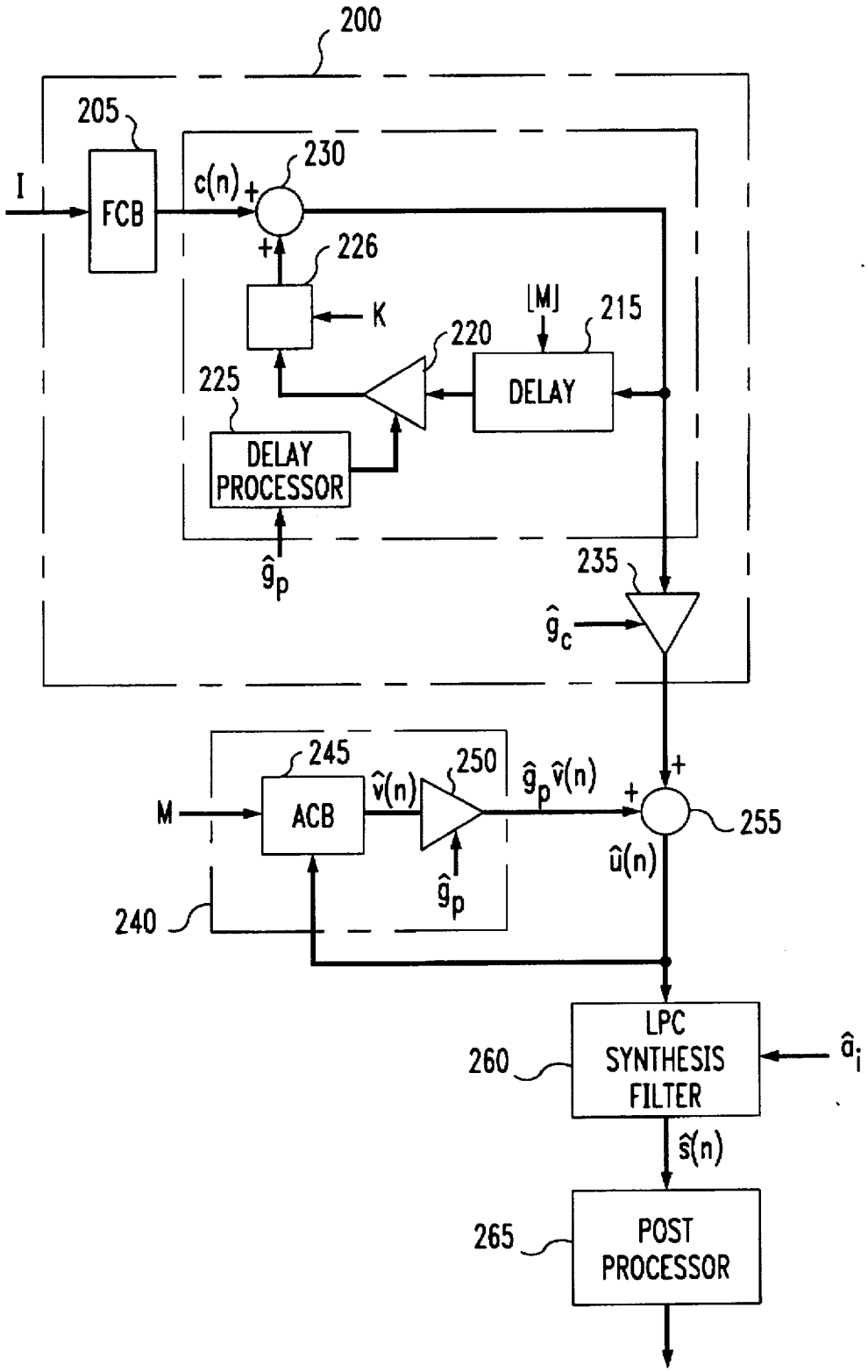
FIG. 4 presents an illustrative embodiment of a decoder in accordance with the present invention.

FIGS. 3 and 4 present illustrative embodiments of the present invention as used in the encoder and decoder of the G.729 Draft. FIG. 3 is a modified version of FIG. 6, which shows the signal flow at the G.729 CS-ACELP encoder. FIG. 3 has been augmented to show the detail of the illustrative encoder embodiment. FIG. 4 is similar to FIG. 7, which shows signal flow at the G.729 CS-ACELP decoder. FIG. 4 is augmented to show the details of the illustrative decoder embodiment. In the discussion which follows, reference will be made to Subsections of the G.729 Draft where appropriate. A general description of the encoder of the G.279 Draft is presented at Subsection II.2.1, while a general description of the decoder is presented at Subsection II.2.2.

A. The Encoder

In accordance with the embodiment, an input speech signal (16 bit PCM at 8 kHz sampling rate) is provided to a preprocessor 100. Preprocessor 100 high-pass filters the speech signal to remove undesirable low frequency components and scales the speech signal to avoid processing overflow. See Subsection II.3.1. The preprocessed speech signal, s(n), is then provided to linear prediction analyzer 105. See Subsection II.3.2. Linear prediction (LP) coefficients, $\bar{a}_i$, are provided to LP synthesis filter 155 which receives an excitation signal, u(n), formed of the combined output of FCB and ACB portions of the encoder. The excitation signal is chosen by using an analysis-by-synthesis search procedure in which the error between the original and synthesized speech is minimized according to a perceptually weighted distortion measure by perceptual weighting filter 165. See Subsection II.3.3

Regarding the ACB portion 112 of the embodiment, a signal representing the perceptually weighted distortion (error) is used by pitch period processor 170 to determine an open-loop pitch-period (delay) used by the adaptive codebook system 110. The encoder uses the determined open-loop pitch-period as the basis of a closed-loop pitch search. ACB 110 computes an adaptive codebook vector, V(n), by interpolating the past excitation at a selected fractional pitch. See Subsection II.3.4–II.3.7. The adaptive codebook gain amplifier 115 applies a scale factor $\hat{g}_p$ to the output of the ACB system 110. See Subsection II.3.9.2.

Regarding the FCB portion 118 of the embodiment, an index generated by the mean squared error (MSE) search processor 175 is received by the FCB system 120 and a codebook vector, c(n), is generated in response. See Subsection II.3.8. This codebook vector is provided to the PPF system 128 operating in accordance with the present invention (see discussion below). The output of the PPF system 128 is scaled by FCB amplifier 145 which applies a scale factor $\hat{g}_c$. Scale factor $\hat{g}_c$ is determined in accordance with Subsection II.3.9.

The vectors output from the ACB and FCB portions 112, 118 of the encoder are summed at summer 150 and provided to the LP synthesis filter as discussed above.

B. The PPF System

As mentioned above, the PPF system addresses the shortcoming of the ACB system exhibited when the pitch-period of the speech being synthesized is less than the size of the subframe and the fixed PPF gain is too large for speech which is not very periodic.

PPF system 128 includes a switch 126 which controls whether the PPF 128 contributes to the excitation signal. If the delay, M, is less than the size of the subframe, L, than the switch 126 is closed and PPF 128 contributes to the excitation. If $M \geqq L$, switch 126 is open and the PPF 128 does not contribute to the excitation. A switch control signal K is set when $M<L$. Note that use of switch 126 is merely illustrative. Many alternative designs are possible, including, for example, a switch which is used to by-pass PPF 128 entirely when $M \geqq L$.

The delay used by the PPF system is the integer portion of the pitch-period, M, as computed by pitch-period processor 170. The memory of delay processor 135 is cleared prior to PPF 128 operation on each subframe. The gain applied by the PPF system is provided by delay processor 125. Processor 125 receives the ACB gain, $\hat{g}_p$, and stores it for one subframe (one subframe delay). The stored gain value is then compared with upper and lower limits of 0.8 and 0.2, respectively. Should the stored value of the gain be either greater than the upper limit or less than the lower limit, the gain is set to the respective limit. In other words, the PPF gain is limited to a range of values greater than or equal to 0.2 and less than or equal to 0.8. Within that range, the gain may assume the value of the delayed adaptive codebook gain.

The upper and lower limits are placed on the value of the adaptive PPF gain so that the synthesized signal is neither overperiodic or aperiodic, which are both perceptually undesirable. As such, extremely small or large values of the ACB gain should be avoided.

It will be apparent to those of ordinary skill in the art that ACB gain could be limited to the specified range prior to storage for a subframe. As such, the processor stores a signal reflecting the ACB gain, whether pre- or post-limited to the specified range. Also, the exact value of the upper and lower limits are a matter of choice which may be varied to achieve desired results in any specific realization of the present invention.

C. The Decoder

The encoder described above (and in the referenced subsections of the G.729 Draft provided in Section II of this specification provides a frame of data representing compressed speech every 10 ms. The frame comprises 80 bits and is detailed in Tables 1 and 9 of the G.729 Draft. Each 80-bit frame of compressed speech is sent over a communication channel to a decoder which synthesizes a speech (representing two subframes) signals based on the frame produced by the encoder. The channel over which the frames are communicated (not shown) may be of any type (such as conventional telephone networks, cellular or wireless networks, ATM networks, etc.) and/or may comprise a storage medium (such as magnetic storage, semiconductor RAM or ROM, optical storage such as CD-ROM, etc.).

An illustrative decoder in accordance with the present invention is presented in FIG. 4. The decoder is much like the encoder of FIG. 3 in that it includes both an adaptive codebook portion 240 and a fixed codebook portion 200. The decoder decodes transmitted parameters (see Subsection II.4.1) and performs synthesis to obtain reconstructed speech.

The FCB portion includes a FCB 205 responsive to a FCB index, I, communicated to the decoder from the encoder. The FCB 205 generates a vector, c(n), of length equal to a subframe. See Subsection II.4.1.3. This vector is applied to the PPF 210 of the decoder. The PPF 210 operates as described above (based on a value of ACB gain, $\hat{g}_p$, delayed in delay processor 225 and ACB pitch-period, M, both received from the encoder via the channel) to yield a vector for application to the FCB gain amplifier 235. The amplifier, which applies a gain, $\hat{g}_c$, from the channel, generates a scaled version of the vector produced by the PPF 210. See Subsection II.4.1.4. The output signal of the amplifier 235 is supplied to summer 255 which generates an excitation signal, u(n).

Also provided to the summer 255 is the output signal generated by the ACB portion 240 of the decoder. The ACB portion 240 comprises the ACB 245 which generates an adaptive codebook contribution, v(n), of length equal to a subframe based on past excitation signals and the ACB pitch-period, M, received from encoder via the channel. See Subsection II.4.1.2. This vector is scaled by amplifier 250 based on gain factor, $\hat{g}_p$ received over the channel. This scaled vector is the output of ACB portion 240.

The excitation signal, u(n), produced by summer 255 is applied to an LPC synthesis filter 260 which synthesizes a speech signal based on LPC coefficients, $\hat{a}_i$, received over the channel. See Subsection II.4.1.6.

Finally, the output of the LPC synthesis filter 260 is supplied to a post processor 265 which performs adaptive postfiltering (see Subsections II.4.2.1–II.4.2.4), high-pass filtering (see Subsection II.4.2.5), and up-scaling (see Subsection II.4.2.5).

I.3 Discussion

Although a number of specific embodiments of this invention have been shown and described herein, it is to be understood that these embodiments are merely illustrative of the many possible specific arrangements which can be devised in application of the principles of the invention. Numerous and varied other arrangements can be devised in accordance with these principles by those of ordinary skill in the art without departing from the spirit and scope of the invention.

For example, should scalar gain quantization be employed, the gain of the PPF may be adapted based on the current, rather than the previous, ACB gain. Also, the values of the limits on the PPF gain (0.2, 0.8) are merely illustrative. Other limits, such as 0.1 and 0.7 could suffice.

In addition, although the illustrative embodiment of present invention refers to codebook "amplifiers," it will be understood by those of ordinary skill in the art that this term encompasses the scaling of digital signals. Moreover, such scaling may be accomplished with scale factors (or gains) which are less than or equal to one (including negative values), as well as greater than one.

The following Appendix to the Detailed Description contains the G.729 Draft described above. This document, at the time of the filing of the present application, is intended to be submitted to a standards body of The International Telecommunications Union (ITU), and provides a more complete description of an illustrative 8 kbit/s speech coding system which employs, inter alia, the principles of the present invention.

APPENDIX TO THE DETAILED DESCRIPTION

SECTION—Draft Recommenation G.729

Coding of Speech at 8kbit/s Using

Conjugate-Structure-Algebraic-Code-Excited

Linear-Predictive (CS-ACELP) Coding

Jun. 7, 1995—Version 4.0

Study Group 15 Contribution—Q.12/15—Submitted to the International Telecommunication Union—Telecommunications Standardization Sector. Until approved by the ITU, neither the C code nor the test vectors contained herein will be available from the ITU. To obtain the C source code, contact Mr. Gerhard Schroeder (Rapporteur SG15/Q.12) at the Deutsche Telekom AG, Postfach 10003, 64276 Darmstadt, Germany; telephone +49 6151 83 3973; facsimile +49 6151 837828; E-mail; gerhard.schroeder@fz13.fz.dbp.de

II.1 INTRODUCTION

This Recommendation contains the description of an algorithm for the coding of speech signals at 8 kbit/s using Conjugate-Structure-Algebraic-Code-Excited Linear-Predictive (CS-ACELP) coding.

This coder is designed to operate with a digital signal obtained by first performing telephone bandwidth filtering (ITU Rec. G.710) of the analog input signal, then sampling it at 8000 Hz, followed by conversion to 16 bit linear PCM for the input to the encoder. The output of the decoder should be converted back to an analog signal by similar means. Other input/output characteristics, such as those specified by ITU Rec. G.711 for 64 kbit/s PCM data, should be converted to 16 bit linear PCM before encoding, or from 16 bit linear PCM to the appropriate format after decoding. The bitstream from the encoder to the decoder is defined within this standard.

This Recommendation is organized as follows: Subsection II.2 gives a general outline of the SC-ACELP algorithm. In Subsections II.3 and II.4, the CS-ACELP encoder and decoder principles are discussed, respectively. Subsection II.5 describes the software that defines this coder in 16 bit fixed point arithmetic.

II.2 General Description of the Coder

The CS-ACELP coder is based on the code-excited linear-predictive (CELP) coding model. The coder operates on speech frames of 10 ms corresponding to 80 samples at a sampling rate of 8000 samples/sec. For every 10 msec frame, the speech signal is analyzed to extract the parameters of the CELP model (LP filter coefficients, adaptive and fixed codebook indices and gains). These parameters are encoded and transmitted. The bit allocation of the coder parameters is shown in Table 1. At the decoder, these parameters are used to retrieve the excitation and synthesis filter

TABLE 1

Bit allocation of the 8 kbit/s CS-ACELP algorithm (10 msec frame).

Figure 5:
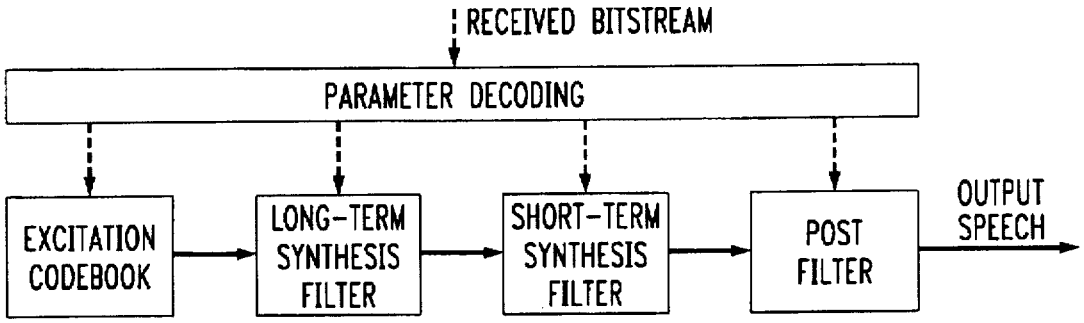
FIG. 5 presents a block diagram of a conceptual G.729 CELP synthesis model.

| Parameter | Codeword | Subframe 1 | Subframe 2 | Total per frame |
|---|---|---|---|---|
| LSP | L0, L1, L2, L3 | | | 18 |
| Adaptive codebook delay | P1, P2 | 8 | 5 | 13 |
| Delay parity | P0 | 1 | | 1 |
| Fixed codebook index | C1, C2 | 13 | 13 | 26 |
| Fixed codebook sign | S1, S2 | 4 | 4 | 8 |
| Codebook gains (stage 1) | GA1, GA2 | 3 | 3 | 6 |
| Codebook gains (stage 2) | GB1, GB2 | 4 | 4 | 8 |
| | | | | — |
| Total | | | | 80 |

parameters. The speech is reconstructed by filtering this excitation through the LP synthesis filter, as is shown in FIG. 5. The short-term synthesis filter is based on a 10th order linear prediction (LP) filter. The long-term, or pitch synthesis filter is implemented using the so-called adaptive codebook approach for delays less than the subframe length. After computing the reconstructed speech, it is further enhanced by a postfilter.

II.2.1 Encoder

Figure 6:
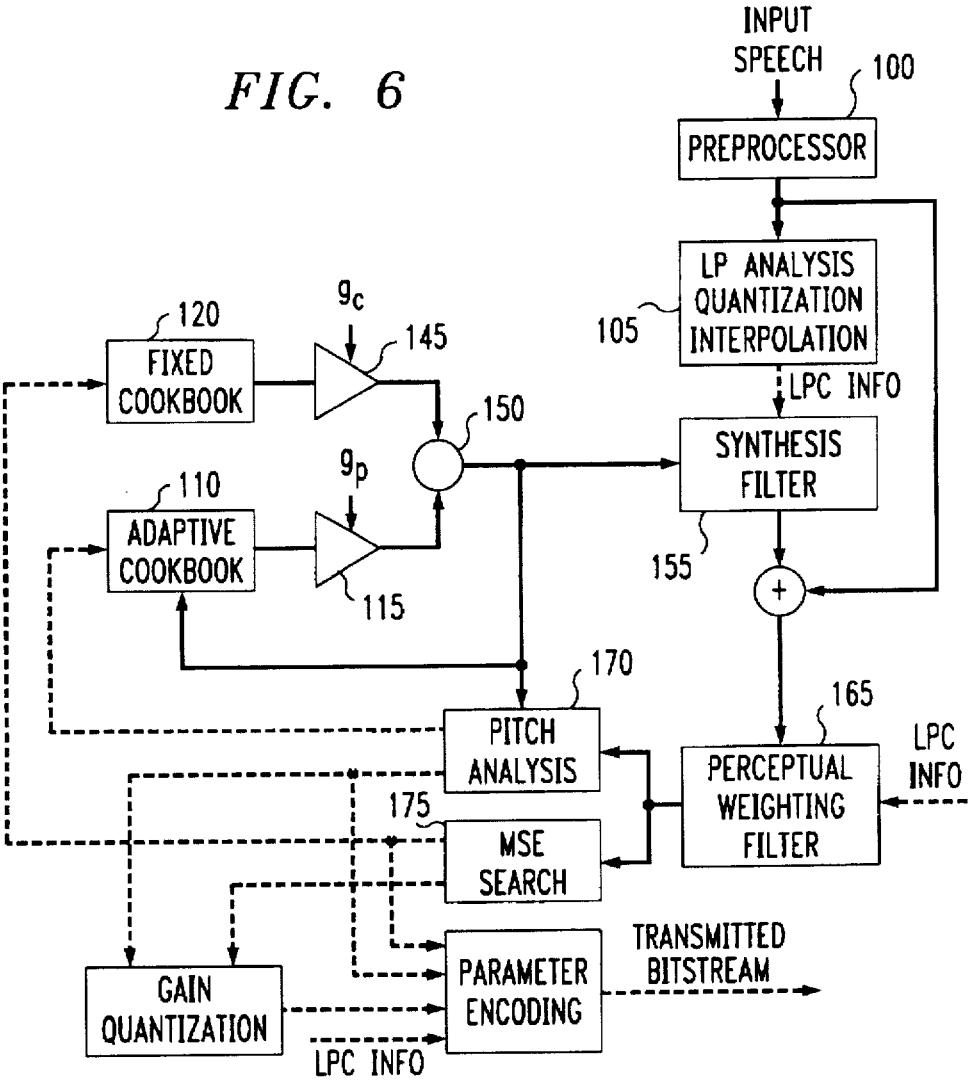
FIG. 6 presents the signal flow at the G.729 CS-ACELP encoder.

The signal flow at the encoder is shown in FIG. 6. The input signal is high-pass filtered and scaled in the pre-processing block. The pre-processed signal serves as the input signal for all subsequent analysis. LP analysis is done once per 10 ms frame to compute the LP filter coefficients. These coefficients are converted to line spectrum pairs (LSP) and quantized using predictive two-stage vector quantization (VQ) with 18 bits. The excitation sequence is chosen by using an analysis-by-synthesis search procedure in which the error between the original and synthesized speech is minimized according to a perceptually weighted distortion measure. This is done by filtering the error signal with a perceptual weighting filter, whose coefficients are derived from the unquantized LP filter. The amount of perceptual weighting is made adaptive to improve the performance for input signals with a flat frequency-response.

The excitation parameters (fixed and adaptive codebook parameters) are determined per subframe of 5 ms (40 samples) each. The quantized and unquantized LP filter coefficients are used for the second subframe, while in the first subframe interpolated LP filter coefficients are used (both quantized and unquantized). An open-loop pitch delay is estimated once per 10 ms frame based on the perceptually weighted speech signal. Then the following operations are repeated for each subframe. The target signal x(n) is computed by filtering the LP residual through the weighted synthesis filter $W(z)/\hat{A}(z)$. The initial states of these filters are updated by filtering the error between LP residual and excitation. This is equivalent to the common approach of subtracting the zero-input response of the weighted synthesis filter from the weighted speech signal. The impulse response, h(n), of the weighted synthesis filter is computed. Closed-loop pitch analysis is then done (to find the adaptive codebook delay and gain), using the target x(n) and impulse response h(n), by searching around the value of the open-loop pitch delay. A fractional pitch delay with ⅓ resolution is used. The pitch delay is encoded with 8 bits in the first subframe and differentially encoded with 5 bits in the second subframe. The target signal x(n) is updated by removing the adaptive codebook contribution (filtered adaptive codevector), and this new target, $x_2(n)$, is used in the fixed algebraic codebook search (to find the optimum excitation). An algebraic codebook with 17 bits is used for the fixed codebook excitation. The gains of the adaptive and fixed codebook are vector quantized with 7 bits, (with MA prediction applied to the fixed codebook gain). Finally, the filter memories are updated using the determined excitation signal.

2.2 Decoder

Figure 7:
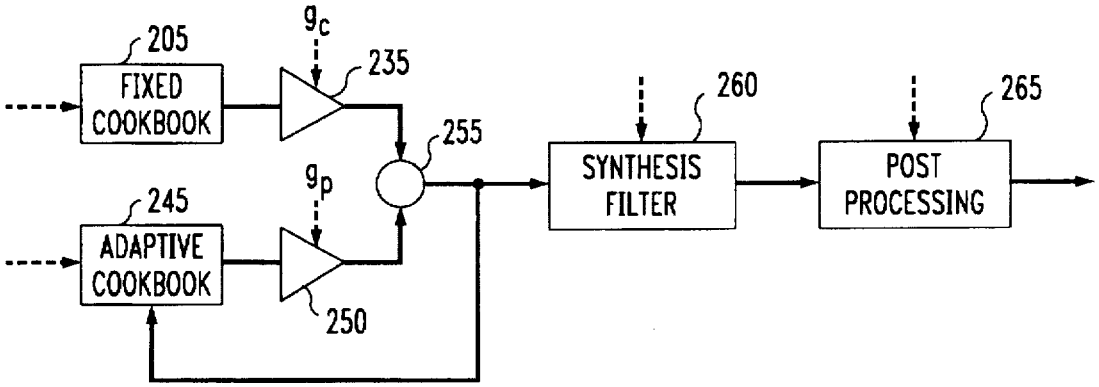

The signal flow at the decoder is shown in FIG. 7. First, the parameters indices are extracted from the received bitstream. These indices are decoded to obtain the coder parameters corresponding to a 10 ms speech frame. These parameters are the LSP coefficients, the 2 fractional pitch delays, the 2 fixed codebook vectors, and the 2 sets of adaptive and fixed codebook gains. The LSP coefficients are interpolated and converted to LP filter coefficients for each subframe. Then, for each 40-sample subframe the following steps are done:

- the excitation is constructed by adding the adaptive and fixed codebook vectors scaled by their respective gains,
- the speech is reconstructed by filtering the excitation through the LP synthesis filter,
- the reconstructed speech signal is passed through a post-processing stage, which comprises of an adaptive postfilter based on the long-term and short-term synthesis filters, followed by a high-pass filter and scaling operation.

II.2.3 Delay

This coder encodes speech and other audio signals with 10 ms frames. In addition, there is a look-ahead of 5 ms, resulting in a total algorithmic delay of 15 ms. All additional delays in a practical implementation of this coder are due to:

- processing time needed for encoding and decoding operations,
- transmission time on the communication link,
- multiplexing delay when combining audio data with other data.

II.2.4 Speech Coder Description

The description of the speech coding algorithm of this Recommendation is made in terms of bit-exact, fixed-point mathematical operations. The ANSI C code indicated in Subsection II.5, which constitutes an integral part of this Recommendation, reflects this bit-exact, fixed-point descriptive approach. The mathematical descriptions of the encoder (Subsection II.3), and decoder (Subsection II.4), can be implemented in several other fashions, possibly leading to a codec implementation not complying with this Recommendation. Therefore, the algorithm description of the C code of Subsection II.5 shall take precedence over the mathematical descriptions of Subsection II.3 and II.4 whenever discrepancies are found. A non-exhaustive set of test sequences which can be used in conjunction with the C code are available from the ITU.

2.5 Notational Conventions

Throughout this document it is tried to maintain the following notational conventions.

- Codebooks are denoted by caligraphic characters (e.g. C).
- Time signals are denoted by the symbol and the sample time index between parenthesis (e.g. s(n)). The symbol n is used as sample instant index.
- Superscript time indices (e.g $g^{(m)}$) refer to that variable corresponding to subframe m.
- Superscripts identify a particular element in a coefficient array.
- A $\hat{0}$ identifies a quantized version of a parameter.
- Range notations are done using square brackets, where the boundaries are included (e.g. [0.6, 0.9]).
- log denotes a logarithm with base 10.

Table 2 lists the most relevant symbols used throughout this document. A glossary of the most relevant signals is given in Table 3. Table 4 summarizes relevant variables and their dimension. Constant parameters are listed in Table 5. The acronyms used in this Recommendation are summarized in Table 6.

TABLE 2

Glossary of symbols.

| Name | Reference | Description |
|---|---|---|
| 1/A(z) | Eq. (2) | LP synthesis filter |
| $H_{h1}(z)$ | Eq. (1) | input high-pass filter |
| $H_p(z)$ | Eq. (77) | pitch postfilter |
| $H_f(z)$ | Eq. (83) | short-term postfilter |
| $H_t(z)$ | Eq. (85) | tilt-compensation filter |
| $H_{h2}(z)$ | Eq. (90) | output high-pass filter |
| P(z) | Eq. (46) | pitch filter |
| W(z) | Eq. (27) | weighting filter |

TABLE 3

Glossary of signals.

| Name | Description |
|---|---|
| h(n) | impulse response of weighting and synthesis filters |
| r(k) | auto-correlation sequence |
| r'(k) | modified auto-correlation sequence |
| R(k) | correlation sequence |
| sw(n) | weighted speech signal |
| s(n) | speech signal |
| s'(n) | windowed speech signal |
| sf(n) | postfiltered output |
| sf'(n) | gain-scaled postfiltered output |
| $\hat{s}$(n) | reconstructed speech signal |
| r(n) | residual signal |
| x(n) | target signal |
| $x_2(n)$ | second target signal |
| v(n) | adaptive codebook contribution |
| c(n) | fixed codebook contribution |
| y(n) | v(n) * h(n) |
| z(n) | c(n) * h(n) |
| u(n) | excitation to LP synthesis filter |
| d(n) | correlation between target signal and h(n) |
| ew(n) | error signal |

TABLE 4

Glossary of variables.

| Name | Size | Description |
|---|---|---|
| $g_p$ | 1 | adaptive codebook gain |
| $g_c$ | 1 | fixed codebook gain |
| $g_0$ | 1 | modified gain for pitch postfilter |
| $g_{pit}$ | 1 | pitch gain for pitch postfilter |
| $g_f$ | 1 | gain term short-term postfilter |
| $g_t$ | 1 | gain term tilt postfilter |
| $T_{op}$ | 1 | open-loop pitch delay |
| $a_i$ | 10 | LP coefficients |
| $k_i$ | 10 | reflection coefficients |
| $o_i$ | 2 | LAR coefficients |
| $w_i$ | 10 | LSF normalized frequencies |
| $q_i$ | 10 | LSP coefficients |
| r(k) | 11 | correlation coefficients |
| $w_i$ | 10 | LSP weighting coefficients |
| $l_i$ | 10 | LSP quantizer output |

TABLE 5

Glossary of constants.

| Name | Value | Description |
|---|---|---|
| $f_s$ | 8000 | sampling frequency |
| $f_0$ | 60 | bandwidth expansion |
| $\gamma_1$ | 0.94/0.98 | weight factor perceptual weighting filter |
| $\gamma_2$ | 0.60/[0.4–0.7] | weight factor perceptual weighting filter |
| $\gamma_n$ | 0.55 | weight factor post filter |
| $\gamma_d$ | 0.70 | weight factor post filter |
| $\gamma_p$ | 0.50 | weight factor pitch post filter |
| $\gamma_t$ | 0.90/0.2 | weight factor tilt post filter |
| C | Table 7 | fixed (algebraic) codebook |
| L0 | Section 3.2.4 | moving average predictor codebook |
| L1 | Section 3.2.4 | First stage LSP codebook |
| L2 | Section 3.2.4 | Second stage LSP codebook (low part) |
| L3 | Section 3.2.4 | Second stage LSP codebook (high part) |
| GA | Section 3.9 | First stage gain codebook |
| GB | Section 3.9 | Second stage gain codebook |
| $w_{lag}$ | Eq. (6) | correlation lag window |
| $w_{lp}$ | Eq. (3) | LPC analysis window |

TABLE 6

Glossary of acronyms.

| Acronym | Description |
|---|---|
| CELP | code-excited linear-prediction |
| MA | moving average |
| MSB | most significant bit |
| LP | linear prediction |
| LSP | line spectral pair |
| LSF | line spectral frequency |
| VQ | vector quantization |

II.3.0 Functional Description of the Encoder

In this section we describe the different functions of the encoder represented in the blocks of FIG. 5.

II.3.1 Pre-Processing

As stated in Subsection II.2, the input to the speech encoder is assumed to be a 16 bit PCM signal. Two pre-processing functions are applied before the encoding process: 1) signal scaling, and 2) high-pass filtering.

The scaling consists of dividing the input by a factor 2 to reduce the possibility of overflows in the fixed-point implementation. The high-pass filter serves as a precaution against undesired low-frequency components. A second order pole/zero filter with a cutoff frequency of 140 Hz is used. Both the scaling and high-pass filtering are combined by dividing the coefficients at the numerator of this filter by 2. The resulting filter is given by $$h_{h1}(z)=\frac{0.46363718-0.92724705z^{-1}+0.46363718z^{-2}}{1-1.9059465z^{-1}+0.9114024z^{-2}}. \quad (1)$$

The input signal filtered through $H_{h1}(z)$ is referred to as s(n), and will be used. in all subsequent coder operations.

II.3.2 Linear Prediction Analysis and Quantization

The short-term analysis and synthesis filters are based on 10th order linear prediction (LP) filters. The LP synthesis filter is defined as $$\frac{1}{\hat{A}(z)}=\frac{1}{1+\sum_{i=1}^{10}\hat{a}_i z^{-i}}, \quad (2)$$

where $\hat{a}_i$, i=1, . . . , 10, are the (quantized) linear prediction (LP) coefficients. Short-term prediction, or linear prediction analysis is performed once per speech frame using the autocorrelation approach with a 30 ms asymmetric window. Every 80 samples (10 ms), the autocorrelation coefficients of windowed speech are computed and converted to the LP coefficients using the Levinson algorithm. Then the LP coefficients are transformed to the LSP domain for quantization and interpolation purposes. The interpolated quantized and unquantized filters are converted back to the LP filter coefficients (to construct the synthesis and weighting filters at each subframe).

II.3.2.1 Windowing and Autocorrelation Computation

The LP analysis window consists of two parts: the first part is half a Hamming window and the second part is a quarter of a cosine function cycle. The window is given by:

$$w_{lp}(n)=\begin{cases}0.54-0.46\cos\left(\frac{2\pi n}{399}\right), & n=0,\ldots,199,\\ \cos\left(\frac{2\pi(n-200)}{159}\right), & n=200,\ldots,239.\end{cases} \quad (3)$$

Figure 8:
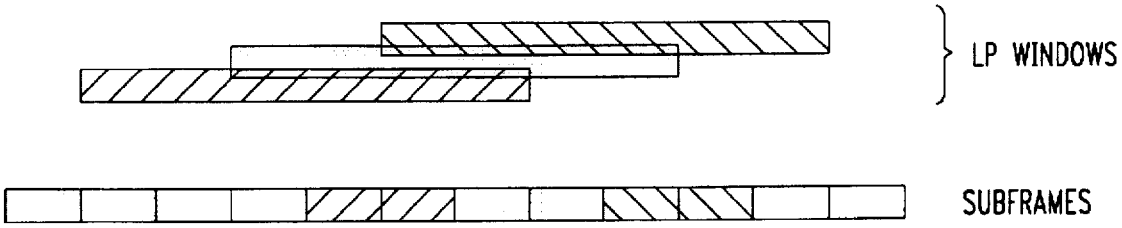

There is a 5 ms lookahead in the LP analysis which means that 40 samples are needed from the future speech frame. This translates into an extra delay of 5 ms at the encoder stage. The LP analysis window applies to 120 samples from past speech frames, 80 samples from the present speech frame, and 40 samples from the future frame. The windowing in LP analysis is illustrated in FIG. 8.

The autocorrelation coefficients of the windowed speech $$s'(n)=w_{lp}(n)s(n),\ n=0,\ldots,239, \quad (4)$$

are computed by $$r(k)=\sum_{n=k}^{239}s'(n)s'(n-k),\quad k=0,\ldots,10, \quad (5)$$

To avoid arithmetic problems for low-level input signals the value of r(0) has a lower boundary of r(0)=1.0. A 60 Hz bandwidth expansion is applied, by multiplying the autocorrelation coefficients with $$w_{lag}(k) = \exp\left[-\frac{1}{2}\left(\frac{2\pi f_0 k}{f_s}\right)^2\right], \quad k = 1, \ldots, 10, \tag{6}$$

where $f_0$=60 Hz is the bandwidth expansion and $f_s$=8000 Hz is the sampling frequency. Further, r(0) is multiplied by the white noise correction factor 1.0001, which is equivalent to adding a noise floor at −40 dB.

II.3.2.2 Levinson-Durbin Algorithm

The modified autocorrelation coefficients $$r'(0)=1.001r(0)$$

$$r'(k)=w_{lag}(k)r(k),\ k=1, \ldots, 10 \tag{7}$$

are used to obtain the LP filter coefficients $a_i$, i=1, . . . , 10, by solving the set of equations $$\sum_{i=1}^{10} a_i r'(|i-k|) = -r'(k), \quad k = 1, \ldots, 10. \tag{8}$$

The set of equations in (8) is solved using the Levinson-Durbin algorithm. This algorithm uses the following recursion:

$$\begin{aligned}
&E(0) = r'(0)\\
&\text{for } i = 1 \text{ to } 10\\
&\quad \alpha_0^{(i-1)} = 1\\
&\quad k_i = -\left[\sum_{j=0}^{i-1} a_j^{(i-1)} r'(i-j)\right] / E(i-1)\\
&\quad a_i^{(i)} = k_i\\
&\quad \text{for } j = 1 \text{ to } i-1\\
&\quad\quad a_j^{(i)} = a_j^{(i-1)} + k_i a_{i-j}^{(i-1)}\\
&\quad \text{end}\\
&\quad E(i) = (1-k_i^2)E(i-1),\\
&\quad \text{if } E(i) < 0 \text{ then } E(i) = 0.01\\
&\text{end}
\end{aligned}$$

The final solution is given as $a_j=a_j^{(10)}$, j=1, . . . , 10.

II.3.2.3 LP to LSP Conversion

The LP filter coefficients $a_i$, i =1, . . . , 10 are converted to the line spectral pair (LSP) representation for quantization and interpolation purposes. For a 10th order LP filter, the LSP coefficients are defined as the roots of the sum and difference polynomials $$F'_1(z)=A(z)+z^{-11}A(z^{-1}), \tag{9}$$

and $$F'_2(z)=A(z)-z^{-11}A(z^{-1}), \tag{10}$$

respectively. The polynomial $F'_1(z)$ is symmetric, and $F'_2(z)$ is antisymmetric. It can be proven that all roots of these polynomials are on the unit circle and they alternate each other. $F'_1(z)$ has a root z=−1(w=π) and $F'_2(z)$ has a root z=1 (w=0). To eliminate these two roots, we define the new polynomials $$F_1(z)=F'_1(z)/(1+z^{-1}), \tag{11}$$

and $$F_2(z)=F'_2(z)/(1-z^{-1}). \tag{12}$$

Each polynomial has 5 conjugate roots on the unit circle ($e^{\pm jwi}$), therefore, the polynomials can be written as $$F_1(z) = \prod_{i=1,3,\ldots,9} (1-2q_i z^{-1}+z^{-2}) \tag{13}$$

-continued and $$F_2(z) = \prod_{i=2,4,\ldots,10} (1-2q_i z^{-1}+z^{-2}), \tag{14}$$

where $q_i$=cos($w_i$) with $w_i$ being the line spectral frequencies (LSF) and they satisfy the ordering property $0<w_1<w_2<\ldots<w_{10}<\pi$. We refer to $q_i$ as the LSP coefficients in the cosine domain.

Since both polynomials $F_1(z)$ and $F_2(z)$ are symmetric only the first 5 coefficients of each polynomial need to be computed. The coefficients of these polynomials are found by the recursive relations $$f_1(i+1)=a_{i+1}+a_{10-i}-f_1(i),\ i=0, \ldots, 4,$$

$$f_2(i+1)=a_{i+1}-a_{10-i}+f_2(i),\ i=0, \ldots, 4, \tag{15}$$

where $f_1(0)=f_2(0)=1.0$. The LSP coefficients are found by evaluating the polynomials $F_1(z)$ and $F_2(z)$ at 60 points equally spaced between 0 and π and checking for sign changes. A sign change signifies the existence of a root and the sign change interval is then divided 4 times to better track the root. The Chebyshev polynomials are used to evaluate $F_1(z)$ and $F_2(z)$. In this method the roots are found directly in the cosine domain $\{q_i\}$. The polynomials $F_1(z)$ or $F_2(z)$, evaluated at $z=e^{jw}$, can be written as $$F(w)=2e^{-j5w}C(x), \tag{16}$$

with $$C(x)=T_5(x)+f(1)T_4(x)+f(2)T_3(x)+f(3)t_2(x)+f(4)T_1(x)+f(5)/2, \tag{17}$$

where $T_m(x)$=cos (mw) is the ruth order Chebyshev polynomial, and f(i), i=1, . . . , 5, are the coefficients of either $F_1(z)$ or $F_2(z)$, computed using the equations in (15). The polynomial C(x) is evaluated at a certain value of x=cos(w) using the recursive relation:

$$\begin{aligned}
&\text{for } k = 4 \text{ downto } 1\\
&\text{Kroon } 4\\
&\quad b_k = 2xb_{k+1} - b_{k+2} + f(5-k)\\
&\text{end}\\
&C(x) = xb_1 - b_2 + f(5)/2
\end{aligned}$$

with initial values $b_5$=1 and $b_6$=0.

II.3.2.4 Quantization of the LSP Coefficients

The LP filter coefficients are quantized using the LSP representation in the frequency domain; that is $$w_i=\arccos(q_i),\ i=1, \ldots, 10, \tag{18}$$

where $w_i$ are the line spectral frequencies (LSF) in the normalized frequency domain [0, π]. A switched 4th order MA prediction is used to predict the current set of LSF coefficients. The difference between the computed and predicted set of coefficients is quantized using a two-stage vector quantizer. The first stage is a 10-dimensional VQ using codebook L1 with 128 entries (7 bits). The second stage is a 10 bit VQ which has been implemented as a split VQ using two 5-dimensional codebooks, L2 and L3 containing 32 entries (5 bits) each.

To explain the quantization process, it is convenient to first describe the decoding process. Each coefficient is obtained from the sum of 2 codebooks:

$$l_i = \begin{cases} LI_i(L1) + L2_i(L2) & i = 1, \ldots, 5, \\ LI_i(L1) + L3_{(i-5)}(L3) & i = 6, \ldots, 10, \end{cases} \quad (19)$$

where L1, L2, and L3 are the codebook indices. To avoid sharp resonances in the quantized LP synthesis filters, the coefficients $l_i$ are arranged such that adjacent coefficients have a minimum distance of J. The rearrangement routine is shown below:

```
for i = 2, . . . 10
  if(l_{i-1} > l_i - J)
    l_{i-1} = (l_i + l_{i-1} - J)/2
    l_i = (l_i + l_{i-1} + J)/2
  end
end
```

This rearrangement process is executed twice. First with a value of J=0.0001, then with a value of J=0.000095.

After this rearrangement process, the quantized LSF coefficients $\hat{w}_i^{(m)}$ for the current frame n, are obtained from the weighted sum of previous quantizer outputs $l^{(m-k)}$, and the current quantizer output $l^{(m)}$ $$\hat{\omega}_i^{(m)} = \left(1 - \sum_{k=1}^{4} m_i^k\right) l_i^{(m)} + \sum_{k=1}^{4} m_i^k l_i^{(m-k)}, \; i = 1, \ldots, 10, \quad (20)$$

where $m_i^k$ are the coefficients of the switched MA predictor. Which MA predictor to use is defined by a separate bit L0. At startup the initial values of $l_i^{(k)}$ are given by $l_i = i\pi/11$ for all k <0.

After computing $\hat{w}_i$, the corresponding filter is checked for stability. This is done as follows:

1. Order the coefficient $\hat{w}_i$ in increasing value,
2. If $\hat{w}_1 < 0.005$ then $\hat{w}_i = 0.005$,
3. If $\hat{w}_{i+1} - \hat{w}_i < 0.0001$, then $\hat{w}_{i+1} = \hat{w}_{i+} 0.0001$ i=1, . . . ,9,
4. If $\hat{w}_{10} > 3.135$ then $\hat{w}_{10} = 3.135$.

The procedure for encoding the LSF parameters can be outlined as follows. For each of the two MA predictors the best approximation to the current LSF vector has to be found. The best approximation is defined as the one that minimizes a weighted mean-squared error $$E_{LPC} = \sum_{i=1}^{10} \omega_i(\omega_i - \omega_i)^2. \quad (21)$$

The weights $w_i$ are made adaptive as a function of the unquantized LSF coefficients, $$w_1 = \begin{cases} 1.0 & \text{if } \omega_2 - 0.04\pi - 1 > 0, \\ 10\,(\omega_2 - 0.04\pi - 1)^2 + 1 & \text{otherwise} \end{cases} \quad (22)$$

$$w_i\; 2 \leqq i \leqq 9 = \begin{cases} 1.0 & \text{if } \omega_{i+1} - \omega_{i-1} - 1 > 0, \\ 10\,(\omega_{i+1} - \omega_{i-1} - 1)^2 + 1 & \text{otherwise} \end{cases}$$

$$w_{10} = \begin{cases} 1.0 & \text{if } -\omega_9 + 0.92\pi - 1 > 0, \\ 10\,(-\omega_9 + 0.92\pi - 1)^2 + 1 & \text{otherwise} \end{cases}$$

In addition, the weights $w_5$ and $w_6$ are multiplied by 1.2 each.

The vector to be quantized for the current frame is obtained from $$l_i' = \left[\hat{\omega}_i^{(m)} - \sum_{k=1}^{4} m_i^k l_i^{(m-k)}\right] / \left(1 - \sum_{k=1}^{4} m_i^k\right), \; i = 1, \ldots, 10. \quad (23)$$

The first codebook L1 is searched and the entry L1 that minimizes the (unweighted) mean-squared error is selected. This is followed by a search of the second codebook L2, which defines the lower part of the second stage. For each possible candidate, the partial vector $\hat{w}_i$, i=1, . . . ,5 is reconstructed using Eq. (20), and rearranged to guarantee a minimum distance of 0.0001. The vector with index L2 which after addition to the first stage candidate and rearranging, approximates the lower part of the corresponding target best in the weighted MSE sense is selected. Using the selected first stage vector L1 and the lower part of the second stage (L2), the higher part of the second stage is searched from codebook L3. Again the rearrangement procedure is used to guarantee a minimum distance of 0.0001. The vector L3 that minimizes the overall weighted MSE is selected.

This process is done for each of the two MA predictors defined by L0, and the MA predictor L0 that produces the lowest weighted MSE is selected.

II.3.2.5 Interpolation of the LSP Coefficients

The quantized (and unquantized) LP coefficients are used for the second subframe. For the first subframe, the quantized (and unquantized) LP coefficients are obtained from linear interpolation of the corresponding parameters in the adjacent subframes. The interpolation is done on the LSP coefficients in the q domain. Let $q_i^{(m)}$ be the LSP coefficients at the 2nd subframe of frame m, and $q_i^{(m-1)}$ the LSP coefficients at the 2nd subframe of the past frame (m−1). The (unquantized) interpolated LSP coefficients in each of the 2 subframes are given by $$\begin{aligned} &\text{Subframe 1:} \quad q1_i = 0.5q_i^{(m-1)} + 0.5q_i^{(m)}, && i = 1, \ldots, 10, \\ &\text{Subframe 2:} \quad q2_i = q_i^{(m)} && i = 1, \ldots, 10. \end{aligned} \quad (24)$$

The same interpolation procedure is used for the interpolation of the quantized LSP coefficients by substituting $q_i$ by $\hat{q}_i$ in Eq. (24).

II.3.2.6 LSP to LP Conversion

Once the LSP coefficients are quantized and interpolated, they are converted back to LP coefficients $\{a_i\}$. The conversion to the LP domain is done as follows. The coefficients of $F_1(z)$ and $F_2(z)$ are found by expanding Eqs. (13) and (14) knowing the quantized and interpolated LSP coefficients. The following recurslye relation is used to compute $f_1(i)$, i=1, . . . 5, from $q_i$

```
for i = 1 to 5
  f1(i) = -2q_{2i-1}f1(i - 1) + 2f1(i - 2)
  for j = i - 1 downto 1
    f1(j) = f1(j) - 2q_{2i-1}f1(j - 1) + f1(j - 2)
  end
end
```

with initial values $f_1(0)=1$ and $f_1(-1)=0$. The coefficients $f_2(i)$ are computed similarly by replacing $q_{2i-1}$ by $q_{2i}$.

Once the coefficients $f_1(i)$ and $f_2(i)$ are found, $F_1(z)$ and $F_2(z)$ are multiplied by $1+z^{-1}$ and $1-z^{-1}$ respectively, to obtain $F'_1(z)$ and $F'_2(z)$; that is $$\begin{aligned} &f'_1(i) = f_1(i) + f_1(i-1), \; i = 1, \ldots, 5, \\ &f'_2(i) = f_2(i) - f_2(i-1), \; i = 1, \ldots, 5. \end{aligned} \quad (25)$$

Finally the LP coefficients are found by $$a_i = \begin{cases} 0.5f_1'(i) + 0.5f_2'(i), & i = 1, \ldots, 5, \\ 0.5f_1'(i-5) - 0.5f_2'(i-5), & i = 6, \ldots, 10. \end{cases} \quad (26)$$

This is directly derived from the relation $A(z) = (F'_1(z) + F'_2(z))/2$; and because $F'_1(z)$ and $F'_2(z)$ are symmetric and antisymmetric polynomials, respectively.

II.3.3 Perceptual Weighting

The perceptual weighting filter is based on the unquantized LP filter coefficients and is given by $$W(z)=\frac{A(z/\gamma_1)}{A(z/\gamma_2)}=\frac{1+\sum_{i=1}^{10}\gamma_1^i a_i z^{-i}}{1+\sum_{i=1}^{10}\gamma_2^i a_i z^{-i}}, \tag{27}$$

The values of $\gamma_1$ and $\gamma_2$ determine the frequency response of the filter W(z). By proper adjustment of these variables it is possible to make the weighting more effective. This is accomplished by making $\gamma_1$ and $\gamma_2$ a function of the spectral shape of the input signal. This adaptation is done once per 10 ms frame, but an interpolation procedure for each first subframe is used to smooth this adaptation process. The spectral shape is obtained from a 2nd-order lineax prediction filter, obtained as a by product from the Levinson-Durbin recursion (Subsection II.3.2.2). The reflection coefficients $k_i$, are converted to Log Area Ratio (LAR) coefficients $o_i$ by $$o_i=\log\frac{(1.0+k_i)}{(1.0-k_i)} \quad i=1,2. \tag{28}$$

These LAR coefficients are used for the second subframe. The LAR, coefficients for the first subframe are obtained through linear interpolation with the LAR parameters from the previous frame, and are given by:

$$\begin{aligned}&\text{Subframe 1:}\quad o1_i=0.5o_i^{(m-1)}+0.5o_i^{(m)}, \quad i=1,\ldots,2,\\ &\text{Subframe 2:}\quad o2_i=o_i^{(m)}, \quad i=1,\ldots,2.\end{aligned} \tag{29}$$

The spectral envelope is characterized as being either flat (flat=1) or tilted (flat=0). For each subframe this characterization is obtained by applying a threshold function to the LAR coefficients. To avoid rapid changes, a hysteresis is used by taking into account the value of flat in the previous subframe (m−1), $$\text{flat}^{(m)}=\begin{cases}0 & \text{if } o_1<-1.74 \text{ and } o_2>0.65 \text{ and flat}^{(m-1)}=1,\\ 1 & \text{if } o_1>-1.52 \text{ and } o_2<0.43 \text{ and flat}^{(m-1)}=0,\\ \text{flat}^{(m-1)} & \text{otherwise.}\end{cases} \tag{30}$$

If the interpolated spectrum for a subframe is classified as flat ($\text{flat}^{(m)}=1$), the weight factors are set to $\gamma_1=0.94$ and $\gamma_2=0.6$. If the spectrum is classified as tilted ($\text{flat}^{(m)}=0$), the value of $\gamma_1$, is set to 0.98, and the value of $\gamma_2$ is adapted to the strength of the resonances in the LP synthesis filter, but is bounded between 0.4 and 0.7. If a strong resonance is present, the value of $\gamma_2$ is set closer to the upperbound. This adaptation is achieved by a criterion based on the minimum distance between 2 successive LSP coefficients for the current subframe. The minimum distance is given by $$d_{min}=min[w_{i+1}-w_i]i=1,\ldots,9. \tag{31}$$

The following linear relation is used to compute $\gamma_2$:

$$\gamma_2=-6.0*d_{min}+1.0, \textit{ and } 0.4\leqq\gamma_2\leqq0.7 \tag{32}$$

The weighted speech signal in a subframe is given by $$sw(n)=s(n)+\sum_{i=1}^{10}a_i\gamma_1^i s(n-i)-\sum_{i=1}^{10}a_i\gamma_2^i sw(n-i),\ n=0,\ldots,39. \tag{33}$$

The weighted speech signal sw(n) is used to find an estimation of the pitch delay in the speech frame.

II.3.4 Open-Loop Pitch Analysis

To reduce the complexity of the search for the best adaptive codebook delay, the search range is limited around a candidate delay $T_{op}$, obtained from an open-loop pitch analysis. This open-loop pitch analysis is done once per frame (10 ms). The open-loop pitch estimation uses the weighted speech signal sw(n) of Eq. (33), and is done as follows: In the first step, 3 maxima of the correlation $$R(k)=\sum_{n=0}^{79}sw(n)sw(n-k) \tag{34}$$

are found in the following three ranges $$\begin{aligned}i=1:&\quad 80,\ldots,143,\\ i=2:&\quad 40,\ldots,79,\\ i=3:&\quad 20,\ldots,39.\end{aligned}$$

The retained maxima $R(t_i)$, i=1, . . . 3, are normalized through $$R'(t_i)=\frac{R(t_i)}{\sqrt{\Sigma_n sw^2(n-t_i)}},\ i=1,\ldots,3, \tag{35}$$

The winner among the three normalized correlations is selected by favoring the delays with the values in the lower range. This is done by weighting the normalized correlations correspondiffg to the longer delays. The best open-loop delay $T_{op}$ is determined as follows:

```
T_op = t_1
R'(T_op) = R'(t_1)
if R'(t_2) ≧ 0.85R'(T_op)
    R'(T_op) = R'(t_2)
    T_op = t_2
end
if R'(t_3) ≧ 0.85R'(T_op)
    R'(T_op) = R'(t_3)
    T_op = t_3
end
```

This procedure of dividing the delay range into 3 sections and favoring the lower sections is used to avoid choosing pitch multiples.

II3.5 Computation of the Impulse Response

The impulse response, h(n), of the weighted synthesis filter $W(z)/\hat{A}(z)$ is computed for each subframe. This impulse response is needed for the search of adaptive and fixed codebooks. The impulse response h(n) is computed by filtering the vector of coefficients of the filter $A(z/\gamma_1)$ extended by zeros through the two filters $1/\hat{A}(z)$ and $1/A(z/\gamma_2)$.

II3.6 Computation of the Target Signal

The target signal x(n) for the adaptive codebook search is usually computed by subtracting the zero-input response of the weighted synthesis filter $W(z)/\hat{A}(z)=A(z/\gamma_1)/[\hat{A}(z)A(z/\gamma_2)]$ from the weighted speech signal sw(n) of Eq. (33). This is done on a subframe basis.

An equivalent procedure for computing the target signal, which is used in this Recommendation, is the filtering of the LP residual signal r(n) through the combination of synthesis filter $1/\hat{A}(z)$ and the weighting filter $A(z/\gamma_1)/A(z/\gamma_2)$. After determining the excitation for the subframe, the initial states of these filters are updated by filtering the difference between the LP residual and excitation. The memory update of these filters is explained in Subsection II.3.10.

The residual signal r(n), which is needed for finding the target vector is also used in the adaptive codebook search to extend the past excitation buffer. This simplifies the adaptive codebook search procedure for delays less than the subframe size of 40 as will be explained in the next section. The LP residual is given by $$r(n) = s(n) + \sum_{i=1}^{10} \hat{a}_i s(n-i),\ n = 0, \ldots, 39. \tag{36}$$

II.3.7 Adaptive-Codebook Search

The adaptive-codebook parameters (or pitch parameters) are the delay and gain. In the adaptive codebook approach for implementing the pitch filter, the excitation is repeated for delays less than the subframe length. In the search stage, the excitation is extended by the LP residual to simplify the closed-loop search. The adaptive-codebook search is done every (5 ms) subframe. In the first subframe, a fractional pitch delay $T_1$ is used with a resolution of ⅓ in the range [19⅓, 84⅔] and integers only in the range [85, 143]. For the second subframe, a delay $T_2$ with a resolution of ⅓ is always used in the range [(int)$T_1$−5⅔, (int)$T_1$+4⅔], where (int)$T_1$ is the nearest integer to the fractional pitch delay $T_1$ of the first subframe. This range is adapted for the cases where $T_1$ straddles the boundaries of the delay range.

For each subframe the optimal delay is determined using closed-loop analysis that minimizes the weighted mean-squared error. In the first subframe the delay $T_1$ is found be searching a small range (6 samples) of delay values around the open-loop delay $T_{op}$ (see Subsection II.3.4). The search boundaries $t_{min}$ and $t_{max}$ are defined by $t_{min} = T_{op} - 3$
if $t_{min} < 20$ then $t_{min} = 20$
$t_{max} = t_{min} + 6$
if $t_{max} > 143$ then
  $t_{max} = 143$
  $t_{min} = t_{max} - 6$
end For the second subframe, closed-loop pitch analysis is done around the pitch selected in the first subframe to find the optimal delay $T_2$. The search boundaries are between $t_{min}$−⅔ and $t_{max}$+⅔, where $t_{min}$ and $t_{max}$ are derived from $T_1$ as follows:

$t_{min} = (\text{int})T_1 - 5$
if $t_{min} < 20$ then $t_{min} = 20$
$t_{max} = t_{min} + 9$
if $t_{max} > 143$ then
  $t_{max} = 143$
  $t_{min} = t_{max} - 9$
end The closed-loop pitch search minimizes the mean-squared weighted error between the original and synthesized speech. This is achieved by maximizing the term $$R(k) = \frac{\sum_{n=0}^{39} x(n) y_k(n)}{\sqrt{\sum_{n=0}^{39} y_k(n) y_k(n)}}, \tag{37}$$

where x(n) is the target signal and $y_k(n)$ is the past filtered excitation at delay k (past excitation convolved with h(n)). Note that the search range is limited around a preselected value, which is the open-loop pitch $T_{op}$ for the first subframe, and $T_1$ for the second subframe.

The convolution $y_k(n)$ is computed for the delay $t_{min}$, and for the other integer delays in the search range $k=t_{min}+1, \ldots, t_{max}$, it is updated using the recursive relation $$y_k(n) = y_{k-1}(n-1) + u(-k)h(n),\ n=39, \ldots, 0, \tag{38}$$

where u(n), n=−143, . . . , 39, is the excitation buffer, and $y_{k-1}(-1)=0$. Note that in the search stage, the samples u(n), n=0, . . . , 39 are not known, and they are needed for pitch delays less than 40. To simplify the search, the LP residual is copied to u(n) to make the relation in Eq. (38) valid for all delays.

For the determination of $T_2$, and $T_1$ if the optimum integer closed-loop delay is less than 84, the fractions around the optimum integer delay have to be tested. The fractional pitch search is done by interpolating the normalized correlation in Eq. (37) and searching for its maximum. The interpolation is done using a FIR filter $b_{12}$ based on a Hamming windowed sine function with the sinc truncated at ±11 and padded with zeros at ±12 ($b_{12}(12)=0$). The filter has its cut-off frequency (3 dB) at 3600 Hz in the oversampled domain. The interpolated values of R(k) for the fractions −⅔, −⅓, 0, ⅓, and ⅔ are obtained using the interpolation formula $$R(k)_t = \sum_{i=0}^{3} R(k-i) b_{12}(t + i \cdot 3) + \sum_{i=0}^{3} R(k+1+i) b_{12}(3 - t + i \cdot 3),\quad t = 0, 1, 2, \tag{39}$$

where t=0, 1, 2 corresponds to the fractions 0, ⅓, and ⅔, respectively. Note that it is necessary to compute correlation terms in Eq. (37) using a range $t_{min}$−4, $t_{max}$+4, to allow for the proper interpolation.

II.3.7.1 Generation of the Adaptive Codebook Vector

Once the noninteger pitch delay has been determined, the adaptive codebook vector v(n) is computed by interpolating the past excitation signal u(n) at the given integer delay k and fraction t $$v(n) = \sum_{i=0}^{9} u(n-k+i) b_{30}(t + i \cdot 3) + \sum_{i=0}^{9} u(n-k+1+i) b_{30}(3 - t + i \cdot 3),\ n = 0, \ldots, 39,\ t = 0, 1, 2. \tag{40}$$

The interpolation filter $b_{30}$ is based on a Hamming windowed sine functions with the sine truncated at ±29 and padded with zeros at ±30 ($b_{30}(30)=0$). The filters has a cut-off frequency (−3 dB) at 3600 Hz in the oversampled domain.

II.3.7.2 Codeword Computation for Adaptive Codebook Delays

The pitch delay $T_1$ is encoded with 8 bits in the first subframe and the relative delay in the second subframe is encoded with 5 bits. A fractional delay T is represented by its integer part (int)T, and a fractional part frac/3, frac=−1, 0,1. The pitch index P1, is now encoded as $$P1 = \begin{cases} ((\text{int})T_1 - 19)*3 + \text{frac} - 1, & \text{if } T_1 = [19, \ldots, 85],\ \text{frac} = [-1, 0, 1] \\ ((\text{int})T_1 - 85) + 197, & \text{if } T_1 = [86, \ldots, 143],\ \text{frac} = 0 \end{cases} \tag{41}$$

The value of the pitch delay $T_2$ is encoded relative to the value of $T_1$. Using the same interpretation as before, the fractional delay $T_2$ represented by its integer part (int)$T_2$, and a fractional part frac/3, frac=−1,0,1, is encoded as $$P2 = ((\text{int})T_2 - t_{min})*3 + frac + 2 \tag{42}$$

where $t_{min}$ is derived from $T_1$ as before.

To make the coder more robust against random bit errors, a parity bit P0 is computed on the delay index of the first subframe. The parity bit is generated through an XOR operation on the 6 most significant bits of P1. At the decoder this parity bit is recomputed and if the recomputed value does not agree with the transmitted value, an error concealment procedure is applied.

II.3.7.3 Computation of the Adaptive-Codebook Gain

Once the adaptive-codebook delay is determined, the adaptive-codebook gain $g_p$ is computed as $$g_p = \frac{\sum_{n=0}^{39} x(n)y(n)}{\sum_{n=0}^{39} y(n)y(n)}, \text{ bounded by } 0 \leqq g_p \leqq 1.2, \tag{43}$$

where y(n) is the filtered adaptive codebook vector (zero-state response of $W(z)/\hat{A}(z)$ to v(n)). This vector is obtained by convolving v(n) with h(n)

$$y(n) = \sum_{i=0}^{n} v(i)h(n-i) \; n = 0, \ldots, 39. \tag{44}$$

Note that by maximizing the term in Eq. (37) in most cases $g_p>0$. In case the signal contains only negative correlations, the value of $g_p$ is set to 0.

II.3.8 Fixed Codebook: Structure and Search

The fixed codebook is based on an algebraic codebook structure using an interleaved single-pulse permutation (ISPP) design. In this codebook, each codebook vector contains 4 non-zero pulses. Each pulse can have either the amplitudes +1 or −1, and can assume the positions given in Table 7.

The codebook vector c(n) is constructed by taking a zero vector, and putting the 4 unit pulses at the found locations, multiplied with their corresponding sign.

$$c(n)=s0\delta(n-i0)+s1\delta(n-i1)+s2\delta(n-i2)+s3\delta(n-i3), \; n=0, \ldots, 39. \tag{45}$$

where $\delta(0)$ is a unit pulse. A special feature incorporated in the codebook is that the selected codebook vector is filtered through an adaptive pre-filter P(z) which enhances harmonic components to improve the synthesized speech quality. Here the filter $$P(z)=1/(1-\beta z^{-T}) \tag{46}$$

TABLE 7

Structure of fixed codebook C.

| Pulse | Sign | Positions |
|---|---|---|
| i0 | s0 | 0, 5, 10, 15, 20, 25, 30, 35 |
| i1 | s1 | 1, 6, 11, 16, 21, 26, 31, 36 |
| i2 | s2 | 2, 7, 12, 17, 22, 27, 32, 37 |
| i3 | s3 | 3, 8, 13, 18, 23, 28, 33, 38 |
| | | 4, 9, 14, 19, 24, 29, 34, 39 |

is used, where T is the integer component of the pitch delay of the current subframe, and β is a pitch gain. The value of β is made adaptive by using the quantized adaptive codebook gain from the previous subframe bounded by 0.2 and 0.8.

$$\beta=\hat{g}_p^{(m-1)}, \; 0.2 \leqq \beta \leqq 0.8. \tag{47}$$

This filter enhances the harmonic structure for delays less than the subframe size of 40. This modification is incorporated in the fixed codebook search by modifying the impulse response h(n), according to $$h(n)=h(n)+\beta h(n-i), \; n=T, \ldots, 39. \tag{48}$$

II.3.8.1 Fixed-Codebook Search Procedure

The fixed codebook is searched by minimizing the mean-squared error between the weighted input speech sw(n) of Eq. (33), and the weighted reconstructed speech. The target signal used in the closed-loop pitch search is updated by subtracting the adaptive codebook contribution. That is $$x_2(n)=x(n)-g_p y(n), \; n=0, \ldots, 39, \tag{49}$$

where y(n) is the filtered adaptive codebook vector of Eq. (44).

The matrix H is defined as the lower triangular Toepliz convolution matrix with diagonal h(0) and lower diagonals h(1), . . . , h(39). If $c_k$ is the algebraic codevector at index k, then the codebook is searched by maximizing the term $$\frac{C_k^2}{E_k} = \frac{\left(\sum_{n=0}^{39} d(n)c_k(n)\right)^2}{c_k^t \Phi c_k}, \tag{50}$$

where d(n) is the correlation between the target signal $x_2(n)$ and the impulse response h(n), and $\Phi=H^tH$ is the matrix of correlations of h(n). The signal d(n) and the matrix Φ are computed before the codebook search. The elements of d(n) are computed from $$d(n) = \sum_{i=n}^{39} x(i)h(i-n), \; n=0, \ldots, 39, \tag{51}$$

and the elements of the symmetric matrix Φ are computed by $$\phi(i,j) = \sum_{n=j}^{39} h(n-i)h(n-j), \; (j \geqq i), \tag{52}$$

Note that only the elements actually needed are computed and an efficient storage procedure has been designed to speed up the search procedure.

The algebraic structure of the codebook C allows for a fast search procedure since the codebook vector $c_k$ contains only four nonzero pulses. The correlation in the numerator of Eq. (50) for a given vector $c_k$ is given by $$C = \sum_{i=0}^{3} a_i d(m_i), \tag{53}$$

where $m_i$ is the position of the ith pulse and $a_i$ is its amplitude. The energy in the denominator of Eq. (50) is given by $$E = \sum_{i=0}^{3} \phi(m_i, m_i) + 2 \sum_{i=0}^{2} \sum_{j=i+1}^{3} a_i a_j \phi(m_i, m_j). \tag{54}$$

To simplify the search procedure, the pulse amplitudes are predetermined by quantizing the signal d(n). This is done by setting the amplitude of a pulse at a certain position equal to the sign of d(n) at that position. Before the codebook search, the following steps are done. First, the signal d(n) is decomposed into two signals: the absolute signal $d'(n)=|d(n)|$ and the sign signal sign[d(n)]. Second, the matrix Φ is modified by including the sign information; that is, $$\phi'(i,j)=sign[d(i)]sign[d(j)]\phi(i,j), \; i=0, \ldots, 39, \; j=i, \ldots, 39. \tag{55}$$

To remove the factor 2 in Eq. (54)

$$\phi'(i,i)=0.5\phi(i,i), \; i=0, \ldots, 39. \tag{56}$$

The correlation in Eq. (53) is now given by $$C=d'(m_0)+d'(m_1)+d'(m_2)+d'(m_3), \tag{57}$$

and the energy in Eq. (54) is given by $$E = \phi'(m_0, m_0) + \phi'(m_1, m_1) + \phi'(m_0, m_1) + \phi'(m_2, m_2) + \phi'(m_0, m_2) + \phi'(m_1, m_2) + \phi'(m_3, m_3) + \phi'(m_0, m_3) + \phi'(m_1, m_3) + \phi'(m_2, m_3). \quad (58)$$

A focused search approach is used to further simplify the search procedurel. In this approach a precomputed threshold is tested before entering the last loop, and the loop is entered only if this threshold is exceeded. The maximum number of times the loop can be entered is fixed so that a low percentage of the codebook is searched. The threshold is computed based on the correlation C. The maximum absolute correlation and the average correlation due to the contribution of the first three pulses, $max_3$ and $av_3$, are found before the codebook search. The threshold is given by $$thr_3 = av_3 + K_3(max_3 - av_3). \quad (59)$$

The fourth loop is entered only if the absolute correlation (due to three pulses) exceeds $thr_3$, where $0 \leqq K_3 < 1$. The value of $K_3$ controls the percentage of codebook search and it is set here to 0.4. Note that this results in a variable search time, and to further control the search the number of times the last loop is entered (for the 2 subframes) cannot exceed a certain maximum, which is set here to 180 (the average worst case per subframe is 90 times).

II.3.8.2 Codeword Computation of the Fixed Codebook

The pulse positions of the pulses i0, i1, and i2, are encoded with 3 bits each, while the position of i3 is encoded with 4 bits. Each pulse amplitude is encoded with 1 bit. This gives a total of 17 bits for the 4 pulses. By defining s=1 if the sign is positive and s=0 is the sign is negative, the sign codeword is obtained from $$S = s0 + 2*s1 + 4*s2 + 8*s3 \quad (60)$$

and the fixed codebook codeword is obtained from $$C = (i0/5) + 8*(i1/5) + 64*(i2/5) + 512*(2*(i3/5) + jx) \quad (61)$$

where jx=0 if i3=3,8, . . . , and jx=1 if i3=4,9, . . .

II.3.9 Quantization of the Gains

The adaptive-codebook gain (pitch gain) and the fixed (algebraic) codebook gain are vector quantized using 7 bits. The gain codebook search is done by minimizing the mean-squared weighted error between original and reconstructed speech which is given by $$E = x'x + g_p^2 y'y + g_c^2 z'z - 2g_p x'y - 2g_c x'z + 2g_p g_c y'z, \quad (62)$$

where x is the target vector (see Subsection II.3.6), y is the filtered adaptive codebook vector of Eq. (44), and z is the fixed codebook vector convolved with h(n), $$z(n) = \sum_{i=0}^{n} c(i)h(n-i) \quad n = 0, \ldots, 39. \quad (63)$$

II.3.9.1 Gain Prediction

The fixed codebook gain $g_c$ can be expressed as $$g_c = \gamma g'_c, \quad (64)$$

where $g'_c$ is a predicted gain based on previous fixed codebook energies, and $\gamma$ is a correction factor.

The mean energy of the fixed codebook contribution is given by $$E = 10 \log\left(\frac{1}{40}\sum_{i=0}^{39} c_i^2\right). \quad (65)$$

After scaling the vector $c_i$ with the fixed codebook gain $g_c$, the energy of the scaled fixed codebook is given by 20 log $g_c$+E. Let $E^{(m)}$ be the mean-removed energy (in dB) of the (scaled) fixed codebook contribution at subframe m, given by $$E^{(m)} = 20 \log g_c + E - \bar{E}, \quad (66)$$

where $\bar{E}$=30 dB is the mean energy of the fixed codebook excitation. The $g_c$ can be expressed as a function of $E^{(m)}$, E, and $\bar{E}$ by $$g_c = 10^{(E^{(m)} + \bar{E} - E)/20}. \quad (67)$$

The predicted gain $g'_c$ is found by predicting the log-energy of the current fixed codebook contribution from the log-energy of previous fixed codebook contributions. The 4th order MA prediction is done as follows. The predicted energy is given by $$\tilde{E}^{(m)} = \sum_{i=1}^{4} b_i \tilde{R}^{(m-i)}, \quad (68)$$

where $[b_1\ b_2\ b_3\ b_4]$=[0.68 0.58 0.34 0.19] are the MA prediction coefficients, and $\hat{R}^{(m)}$ is the quantized version of the prediction error $R^{(m)}$ at subframe m, defined by $$R^{(m)} = E^{(m)} - \tilde{E}^{(m)}. \quad (69)$$

The predicted gain $g'_c$ is found by replacing $E^{(m)}$ by its predicted value in Eq (67).

$$g'_c = 10^{(\tilde{E}^{(m)} + \bar{E} - E)/20}. \quad (70)$$

The correction factor $\gamma$ is related to the gain-prediction error by $$R^{(m)} = E^{(m)} - \tilde{E}^{(m)} = 20 \log(\gamma). \quad (71)$$

II.3.9.2 Codebook Search for Gain Quantization

The adaptive-codebook gain, $g_p$, and the factor $\gamma$ are vector quantized using a 2-stage conjugate structured codebook. The first stage consists of a 3 bit two-dimensional codebook GA, and the second stage consists of a 4 bit two-dimensional codebook GB. The first element in each codebook represents the quantized adaptive codebook gain $\hat{g}_p$, and the second element represents the quantized fixed codebook gain correction factor $\hat{\gamma}$. Given codebook indices m and n for GA and GB, respectively, the quantized adaptive-codebook gain is given by $$\hat{g}_p = GA_1(m) + GB_1(n) \quad (72)$$

and the quantized fixed-codebook gain by $$\hat{g}_c = g'_c\hat{\gamma} = g'_c(GA_2(m) + GB_2(n)). \quad (73)$$

This conjugate structure simplifies the codebook search, by applying a pre-selection process. The optimum pitch gain $g_p$, and fixed-codebook gain, $g_c$, are derived from Eq. (62), and are used for the pre-selection. The codebook GA contains 8 entries in which the second element (correspOnding to $g_c$) has in general larger values than the first element (corresponding to $g_p$). This bias alloyes a pre-selection using the value of $g_c$. In this pre-selection process, a cluster of 4 vectors whose second element are close to $gx_c$, where $gx_c$ is derived from $g_c$ and $g_p$. Similarly, the codebook GB contains 16 entries in which have a bias towards the first element (corresponding to $g_p$). A cluster of 8 vectors whose first elements are close to $g_p$ are selected. Hence for each codebook the best 50% candidate vectors are selected. This is followed by an exhaustive search over the remaining 4*8=32 possibilities, such that the combination of the two indices minimizes the weighted mean-squared error of Eq. (62).

II.3.9.3 Codeword Computation for Gain Quantizer

The codewords GA and GB for the gain quantizer are obtained from the indices corresponding to the best choice. To reduce the impact of single bit errors the codebook indices are mapped.

II.3.10 Memory Update

An update of the states of the synthesis and weighting filters is needed to compute the target signal in the next subframe. After the two gains are quantized, the excitation signal, u(n), in the present subframe is found by $$u(n)=\hat{g}_p v(n)+\hat{g}_c c(n),\ n=0,\ldots,39, \tag{74}$$

where $\hat{g}_p$ and $\hat{g}_c$ are the quantized adaptive and fixed codebook gains, respectively, v(n) the adaptive codebook vector (interpolated past excitation), and c(n) is the fixed codebook vector (algebraic codevector including pitch sharpening). The states of the filters can be updated by filtering the signal r(n)−u(n) (difference between residual and excitation) through the filters $1/\hat{A}(z)$ and $A(z/\gamma_1)/A(z/\gamma_2)$ for the 40 sample subframe and saving the states of the filters. This would require 3 filter operations. A simpler approach, which requires only one filtering is as follows. The local synthesis speech, $\hat{s}(n)$, is computed by filtering the excitation signal through $1/\hat{A}(z)$. The output of the filter due to the input r(n)−u(n) is equivalent to e(n)=s(n)−$\hat{s}$(n). So the states of the synthesis filter $1/\hat{A}(z)$ are given by e(n), n=30, . . . , 39. Updating the states of the filter $A(z/\gamma_1)/A(z/\gamma_2)$ can be done by filtering the error signal e(n)through this filter to find the perceptually weighted error ew(n). However, the signal ew(n) can be equivalently found by $$ew(n)=x(n)-\hat{g}_p y(n)+\hat{g}_c z(n). \tag{75}$$

Since the signals x(n), y(n), and z(n) are available, the states of the weighting filter are updated by computing ew(n) as in Eq. (75) for n=30, . . . , 39. This saves two filter operations.

II.3.11 Encoder and Decoder Initialization

All static encoder variables should be initialized to 0, except the variables listed in table 8. These variables need to be initialized for the decoder as well.

TABLE 8

Description of parameters with nonzero initialization.

| Variable | Reference | Initial value |
|---|---|---|
| $\beta$ | Section 3.8 | 0.8 |
| $l_i$ | Section 3.2.4 | $i\pi/11$ |
| $q_i$ | Section 3.2.4 | 0.9595, . . . , |
| $\hat{R}^{(k)}$ | Section 3.9.1 | −14 |

II.4.0 Functional Description of the Decoder

The signal now at the decoder was shown in Subsection II.2 (FIG. 7). First the parameters are decoded (LP coefficients, adaptive codebook vector, fixed codebook vector, and gains). These decoded parameters are used to compute the reconstructed speech signal. This process is described in Subsection II.4.1. This reconstructed signal is enhanced by a post-processing operation consisting of a postfilter and a high-pass filter (Subsection II.4.2). Subsection II.4.3 describes the error concealment procedure used when either a parity error has occurred, or when the frame erasure flag has been set.

II.4.1 Parameter Decoding Procedure

The transmitted parameters are listed in Table 9. At startup all static encoder variables should be

TABLE 9

Description of transmitted parameters indices. The bitstream ordering is reflected by the order in the table. For each parameter the most significant bit (MSB) is transmitted first.

| Symbol | Description | Bits |
|---|---|---|
| L0 | Switched predictor index of LSP quantizer | 1 |
| L1 | First stage vector of LSP quantizer | 7 |
| L2 | Second stage lower vector of LSP quantizer | 5 |
| L3 | Second stage higher vector of LSP quantizer | 5 |
| P1 | Pitch delay 1st subframe | 8 |
| P0 | Parity bit for pitch | 1 |
| S1 | Signs of pulses 1st subframe | 4 |
| C1 | Fixed codebook 1st subframe | 13 |
| GA1 | Gain codebook (stage 1) 1st subframe | 3 |
| GB1 | Gain codebook (stage 2) 1st subframe | 4 |
| P2 | Pitch delay 2nd subframe | 5 |
| S2 | Signs of pulses 2nd subframe | 4 |
| C2 | Fixed codebook 2nd subframe | 13 |
| GA2 | Gain codebook (stage 1) 2nd subframe | 3 |
| GB2 | Gain codebook (stage 2) 2nd subframe | 4 |

initialized to 0, except the variables listed in Table 8. The decoding process is done in the following order:

II.4.1.1 Decoding of LP Filter Parameters

The received indices L0, L1, L2, and L3 of the LSP quahtizer are used to reconstruct the quantized LSP coefficients using the procedure described in Subsection II.3.2.4. The interpolation procedure described in Subsection II.3.2.5 is used to obtain 2 interpolated LSP vectors (corresponding to 2 subframes). For each subframe, the interpolated LSP vector is converted to LP filter coefficients $a_i$, which are used for synthesizing the reconstructed speech in the subframe.

The following steps are repeated for each subframe:

1. decoding of the adaptive codebook vector,
2. decoding of the fixed codebook vector,
3. decoding of the adaptive and fixed codebook gains,
4. computation of the reconstructed speech, II.4.1.2 Decoding of the Adaptive Codebook Vector The received adaptive codebook index is used to find the integer and fractional parts of the pitch delay. The integer part (int)$T_1$ and fractional part frac of $T_1$ are obtained from P1 as follows:

```
if P1 < 197
    (int)T_1 = (P1 + 2)/3 + 19
    frac = P1 − (int)T_1*3 + 58
else
    (int)T_1 = P1 − 112
    frac = 0
end
```

The integer and fractional part of $T_2$ are obtained from P2 and $t_{min}$, where $t_{min}$ is derived from P1 as follows

```
t_min = (int)T_1 − 5
if t_min < 20 then t_min = 20
t_max = t_min + 9
if t_max > 143 then
    t_max = 143
    t_min = t_max − 9
```

-continued

```
end
Now T2 is obtained from
    (int)T2 = (P2 + 2)/3 − 1 + tmin
    frac = P2 − 2 − ((P2 + 2)/3 − 1)*3
```

The adaptive codebook vector v(n) is found by interpolating the past excitation u(n) (at the pitch delay) using Eq. (40).

II.4.1.3 Decoding of the Fixed Codebook Vector

The received fixed codebook index C is used to extract the positions of the excitation pulses. The pulse signs are obtained from S. Once the pulse positions and signs are decoded the fixed codebook vector c(n), can be constructed. If the integer part of the pitch delay, T, is less than the subframe size 40, the pitch enhancement procedure is applied which modifies c(n) according to Eq. (48).

II.4.1.4 Decoding of the Adaptive and Fixed Codebook Gains

The received gain codebook index gives the adaptive codebook gain $\hat{g}_p$ and the fixed codebook gain correction factor $\hat{\gamma}$. This procedure is described in detail Subsection II.3.9The estimated fixed codebook gain $g'_c$ is found using Eq. (70). The fixed codebook vector is obtained from the product of the quantized gain correction factor with this predicted gain (Eq. (64)). The adaptive codebook gain is reconstructed using Eq. (72).

II.4.1.5 Computation of the Parity Bit

Before the speech is reconstructed, the parity bit is recomputed from the adaptive codebook delay (Subsection II.3.7.2). If this bit is not identical to the transmitted parity bit P0, it is likely that bit errors occurred during transmission and the error concealment procedure of Subsection II.4.3 is used.

II.4.1.6 Computing the Reconstructed Speech

The excitation u(n) at the input of the synthesis filter (see Eq. (74)) is input to the LP synthesis filter. The reconstructed speech for the subframe is given by $$\hat{s}(n) = u(n) - \sum_{i=1}^{10} \hat{a}_i \hat{s}(n-i), \quad n = 0, \ldots, 39. \tag{76}$$

where $\hat{a}_i$ are the interpolated LP filter coefficients.

The reconstructed speech $\hat{s}(n)$ is then processed by a post processor which is described in the next section.

II.4.2 Post-Processing

Post-processing consists of three functions: adaptive postfiltering, high-pass filtering, and signal up-scaling. The adaptive postfilter is the cascade of three filters: a pitch postfilter $H_p(z)$, a short-term postfilter $H_f(z)$, and a tilt compensation filter $H_t(z)$, followed by an adaptive gain control procedure. The postfilter is updated every subframe of 5 ms. The postfiltering process is organized as follows. First, the synthesis speech $\hat{s}(n)$ is inverse filtered through $\hat{A}(z/\gamma_n)$ to produce the residual signal $\hat{r}(n)$. The signal $\hat{r}(n)$ is used to compute the pitch delay T and gain $g_{pit}$. The signal $\hat{r}(n)$ is filtered through the pitch postfilter $H_p(z)$ to produce the signal r'(n) which, in its turn, is filtered by the synthesis filter $1/[g_f\hat{A}(z/\gamma_d)]$. Finally, the signal at the output of the synthesis filter $1/[g_f\hat{A}(z/\gamma_d)]$ is passed to the tilt compensation filter $H_t(z)$ resulting in the postfiltered synthesis speech signal sf(n). Adaptive gain controle is then applied between sf(n) and $\hat{s}(n)$ resulting in the signal sf'(n). The high-pass filtering and scaling operation operate on the postfiltered signal sf'(n).

II.4.2.1 Pitch Postfilter

The pitch, or harmonic, postfilter is given by $$H_p(z) = \frac{1}{1+g_0}(1+g_0 z^{-T}), \tag{77}$$

where T is the pitch delay and $g_0$ is a gain factor given by $$g_0 = \gamma_p g_{pit} \tag{78}$$

where $g_{pit}$ is the pitch gain. Both the pitch delay and gain are determined from the decoder output signal. Note that $g_{pit}$ is bounded by 1, and it is set to zero if the pitch prediction gain is less that 3 dB. The factor $\gamma_p$ controls the amount of harmonic postfiltering and has the value $\gamma_p$=0.5. The pitch delay and gain are computed from the residual signal $\hat{r}(n)$ obtained by filtering the speech $\hat{s}(n)$ through $\hat{A}(z/\gamma_n)$, which is the numerator of the short-term postfilter (see Subsection II.4.2.2)

$$\hat{r}(n) = \hat{s}(n) + \sum_{i=1}^{10} \gamma_n^i \hat{a}_i \hat{s}(n-i). \tag{79}$$

The pitch delay is computed using a two pass procedure. The first pass selects the best integer $T_0$ in the range $[T_1-1, T_1+1]$, where $T_1$ is the integer part of the (transmitted) pitch delay in the first subframe. The best integer delay is the one that maximizes the correlation $$R(k) = \sum_{n=0}^{39} \hat{r}(n)\hat{r}(n-k). \tag{80}$$

The second pass chooses the best fractional delay T with resolution ⅛ around $T_0$. This is done by finding the delay with the highest normalized correlation.

$$R'(k) = \frac{\sum_{n=0}^{39} \hat{r}(n)\hat{r}_k(n)}{\sqrt{\sum_{n=0}^{39} \hat{r}_k(n)\hat{r}_k(n)}}, \tag{81}$$

where $\hat{r}_k(n)$ is the residual signal at delay k. Once the optimal delay T is found, the corresponding correlation value is compared against a threshold. If R'(T)<0.5 then the harmonic postfilter is disabled by setting $g_{pit}$=0. Otherwise the value of $g_{pit}$ is computed from:

$$g_{pit} = \frac{\sum_{n=0}^{39} \hat{r}(n)\hat{r}_k(n)}{\sum_{n=0}^{39} \hat{r}_k(n)\hat{r}_k(n)}, \quad \text{bounded by } 0 \leqq g_{pit} \leqq 1.0. \tag{82}$$

The noninteger delayed signal $\hat{r}_k(n)$ is first computed using an interpolation filter of length 33. After the selection of T, $\hat{r}_k(n)$ is recomputed with a longer interpolation filter of length 129. The new signal replaces the previous one only if the longer filter increases the value of R'(T).

II.4.2.2 Short-Term Postfilter

The short-term post filter is given by $$H_f(z) = \frac{1}{g_f} \frac{\hat{A}(z/\gamma_n)}{\hat{A}(z/\gamma_d)} = \frac{1}{g_f} \frac{1+\sum_{i=1}^{10} \gamma_n^i \hat{a}_i z^{-i}}{1+\sum_{i=1}^{10} \gamma_d^i \hat{a}_i z^{-i}}, \tag{83}$$

where $\hat{A}(z)$ is the received quantized LP inverse filter (LP analysis is not done at the decoder), and the factors $\gamma_n$ and $\gamma_d$ control the amount of short-term postfiltering, and are set to $\gamma_n$=0.55, and $\gamma_d$=0.7. The gain term $g_f$ is calculated on the truncated impulse response, $h_f(n)$, of the filter $\hat{A}(z/\gamma_n)/\hat{A}(z/\gamma_d)$ and given by $$g_f = \sum_{n=0}^{19} |h_f(n)|. \tag{84}$$

II.4.2.3 Tilt Compensation

Finally, the filter $H_t(z)$ compensates for the tilt in the short-term postfilter $H_f(z)$ and is given by $$H_t(z) = \frac{1}{g_t}(1 + \gamma_t k_1 z^{-1}), \tag{85}$$

where $\gamma_t k_1$ is a tilt factor, $k_1$ being the first reflection coefficient calculated on $h_f(n)$ with $$k_1 = -\frac{r_h(1)}{r_h(0)}; \quad r_h(i) = \sum_{j=0}^{19-i} h_f(j)h_f(j+i). \tag{86}$$

The gain term $g_t = 1 - |\gamma_t k_1|$ compensates for the decreasing effect of gf in $H_f(z)$. Furthermore, it has been shown that the product filter $H_f(z)H_t(z)$ has generally no gain.

Two values for $\gamma_t$ are used depending on the sign of $k_1$. If $k_1$ is negative, $\gamma_t = 0.9$, and if $k_1$ is positive, $\gamma_t = 0.2$.

LI4.2.4 Adaptive Gain Control

Adaptive gain control is used to compensate for gain differences between the reconstructed speech signal $\hat{s}(n)$ and the postfiltered signal sf(n). The gain scaling factor G for the present subframe is computed by $$G = \frac{\sum_{n=0}^{39} |\hat{s}(n)|}{\sum_{n=0}^{39} |sf(n)|}. \tag{87}$$

The gain-scaled postfiltered signal sf'(n) is given by $$sf'(n) = g(n)sf(n),\ n = 0, \ldots, 39, \tag{88}$$

where g(n) is updated on a sample-by-sample basis and given by $$g(n) = 0.85g(n-1) + 0.15G,\ n = 0, \ldots, 39. \tag{89}$$

The initial value of $g(-1) = 1.0$.

II.4.2.5 High-pass Filtering and Up-Scaling

A high-pass filter at a cutoff frequency of 100 Hz is applied to the reconstructed and postfiltered speech sf'(n). The filter is given by $$H_{h2}(z) = \frac{0.93980581 - 1.8795834z^{-1} + 0.93980581z^{-2}}{1 - 1.9330735z^{-1} + 0.93589199z^{-2}}. \tag{90}$$

Up-scaling consists of multiplying the high-pass filtered output by a factor 2 to retrieve the input signal level.

II.4.3 Concealment of Frame Erasures and Parity Errors

An error concealment procedure has been incorporated in the decoder to reduce the degradations in the reconstructed speech because of frame erasures or random errors in the bitstream. This error concealment process is functional when either i) the franie of coder parameters (corresponding to a 10 ms frame) has been identified as being erased, or ii) a checksum error occurs on the parity bit for the pitch delay index P1. The latter could occur when the bitstream has been corrupted by random bit errors.

If a parity error occurs on P1, the delay value $T_1$ is set to the value of the delay of the previous frame. The value of $T_2$ is derived with the procedure outlined in Subsection II.4.1.2, using this new value of $T_1$. If consecutive parity errors occur, the previous value of $T_1$, incremented by 1, is used.

The mechanism for detecting frame erasures is not defined in the Recommendation, and will depend on the application. The concealment strategy has to reconstruct the current frame, based on previously received information. The method used replaces the missing excitation signal with one of similar characteristics, while gradually decaying its energy. This is done by using a voicing classifier based on the long-term prediction gain, which is computed as part of the long-term postfilter analysis. The pitch postfilter (see Subsection II.4.2.1) finds the long-term predictor for which the prediction gain is more than 3 dB. This is done by setting a threshold of 0.5 on the normalized correlation R'(k) (Eq. (81)). For the error concealment process, these frames will be classified as periodic. Otherwise the frame is declared nonperiodic. An erased frame inherits its class from the preceding (reconstructed) speech frame. Note that the voicing classification is continuously updated based on this reconstructed speech signal. Hence, for many consecutive erased frames the classification might change. Typically, this only happens if the original classification was periodic.

The specific steps taken for an erased frame are:

1. repetition of the LP filter parameters,
2. attenuation of adaptive and fixed codebook gains,
3. attenuation of the memory of the gain predictor,
4. generation of the replacement excitation.

II.4.3.1 Repetition of LP Filter Parameters

The LP parameters of the last good frame are used. The states of the LSF predictor contain the values of the received codewords $l_i$. Since the current codeword is not available it is computed from the repeated LSF parameters $\hat{w}_i$ and the predictor memory from $$l_i = \left[\hat{\omega}_i^{(m)} - \sum_{k=1}^{4} m_i^k l_i^{(m-k)}\right] / \left(1 - \sum_{k=1}^{4} m_i^k\right),\ i = 1, \ldots, 10. \tag{91}$$

II.4.3.2 Attenuation of Adaptive and Fixed Codebook Gains

An attenuated version of the previous fixed codebook gain is used.

$$g_c^{(m)} = 0.98 g_c^{(m-1)}. \tag{92}$$

The same is done for the adaptive codebook gain. In addition a clipping operation is used to keep its value below 0.9.

$$g_p^{(m)} = 0.9 g_p^{(m-1)} \text{ and } g_p^{(m)} < 0.9. \tag{93}$$

II.4.3.3 Attenuation of the Memory of the Gain Predictor

The gain predictor uses the energy of previously selected codebooks. To allow for a smooth continuation of the coder once good frames are received, the memory of the gain predictor is updated with an attenuated version of the codebook energy. The value of $\hat{R}^{(m)}$ for the current subframe n is set to the averaged quantized gain prediction error, attenuated by 4 dB.

$$\hat{R}^{(m)} = \left(0.25 \sum_{i=1}^{4} \hat{R}^{(m-i)}\right) - 4.0 \text{ and } \hat{R}^{(m)} \geqq -14. \tag{94}$$

II.4.3.4 Generation of the Replacement Excitation

The excitation used depends on the periodicity classification. If the last correctly received frame was classified as periodic, the current frame is considered to be periodic as well. In that case only the adaptive codebook is used, and the fixed codebook contribution is set to zero. The pitch delay is based on the last correctly received pitch delay and is repeated for each successive frame. To avoid excessive periodicity the delay is increased by one for each next subframe but bounded by 143. The adaptive codebook gain is based on an attenuated value according to Eq. (93).

If the last correctly received frame was classified as nonperiodic, the current frame is considered to be nonperiodic as well, and the adaptive codebook contribution is set to zero. The fixed codebook contribution is generated by randomly selecting a codebook index and sign index. The random generator is based on the function $$seed=seed*31821+13849, \quad (95)$$

with the initial seed value of 21845. The random codebook index is derived from the 13 least significant bits of the next random number. The random sign is derived from the 4 least significant bits of the next random number. The fixed codebook gain is attenuated according to Eq. (92).

II.5.6 Bit-Exact Description of the CS-ACELP Coder

ANSI C code simulating the CS-ACELP coder in 16 bit fixed-point is available from ITU-T. The following sections summarize the use of this simulation code, and how the software is organized.

II.5.1 Use of the Simulation Software

The C code consists of two main programs coder.c, which simulates the encoder, and decoder.c, which simulates the decoder. The encoder is run as follows:

coder inputfile bstreamfile

The inputfile and outputfile are sampled data files containing 16-bit PCM signals. The bitstream file contains 81 16-bit words, where the first word can be used to indicate frame erasure, and the remaining 80 words contain one bit each. The decoder takes this bitstream file and produces a post-filtered output file containing a 16-bit PCM signal.

decoder bstreamfile outputfile

II.5.2 Organization of the Simulation Software

In the fixed-point ANSI C simulation, only two types of fixed-point data are used as is shown in Table 10. To facilitate the implementation of the simulation code, loop indices, Boolean values and

TABLE 10

Data types used in ANSI C simulation.

| Type | Max. value | Min. value | Description |
|---|---|---|---|
| Word16 | 0 × 7fff | 0 × 8000 | signed 2's complement 16 bit word |
| Word32 | 0 × 7fffffffL | 0 × 80000000L | signed 2's complement 32 bit word |

flags use the type Flag, which would be either 16 bit or 32 bits depending on the target platform.

All the computations are done using a predefined set of basic operators. The description of these operators is given in Table 11. The tables used by the simulation coder are summarized in Table 12. These main programs use a library of routines that are summarized in Tables 13, 14, and 15.

TABLE 11

Kroon 4

Basic operations used in ANSI C simulation.

| Operation | Description |
|---|---|
| Word16 sature(Word32 L_var1) | Limit to 16 bits |
| Word16 add(Word16 var1, Word16 var2) | Short addition |
| Word16 sub(Word16 var1, Word16 var2) | Short subtraction |
| Word16 abs_s(Word16 var1) | Short abs |
| Word16 shl(Word16 var1, Word16 var2) | Short shift left |
| Word16 shr(Word16 var1, Word16 var2) | Short shift right |
| Word16 mult(Word16 var1, Word16 var2) | Short multiplication |
| Word32 L_mult(Word16 var1, Word16 var2) | Long multiplication |
| Word16 negate(Word16 var1) | Short negate |
| Word16 extract_h(Word32 L_var1) | Extract high |
| Word16 extract_l(Word32 L_var1) | Extract low |
| Word16 round(Word32 L_var1) | Round |
| Word32 L_mac(Word32 L_var3, Word16 var1, Word16 var2) | Mac |
| Word32 L_msu(Word32 L_var3, Word16 var1, Word16 var2) | Msu |
| Word32 L_macNs(Word32 L_var3, Word16 var1, Word16 var2) | Mac without sat |
| Word32 L_msuNs(Word32 L_var3, Word16 var1, Word16 var2) | Msu without sat |
| Word32 L_add(Word32 L_var1, Word32 L_var2) | Long addition |
| Word32 L_sub(Word32 L_var1, Word32 L_var2) | Long subtraction |
| Word32 L_add_c(Word32 L_var1, Word32 L_var2) | Long add with c |
| Word32 L_sub_c(Word32 L_var1, Word32 L_var2) | Long sub with c |
| Word32 L_negate(Word32 L_var1) | Long negate |
| Word16 mult_r(Word16 var1, Word16 var2) | Multiplication with round |
| Word32 L_shl(Word32 L_var1, Word16 var2) | Long shift left |
| Word32 L_shr(Word32 L_var1, Word16 var2) | Long shift right |
| Word16 shr_r(Word16 var1, Word16 var2) | Shift right with round |
| Word16 mac_r(Word32 L_var3, Word16 var1, Word16 var2) | Mac with rounding |
| Word16 msu_r(Word32 L_var3, Word16 var1, Word16 var2) | Msu with rounding |
| Word32 L_deposit_h(Word16 var1) | 16 bit var1 -¿ MSB |
| Word32 L_deposit_l(Word16 var1) | 16 bit var1 -¿ LSB |
| Word32 L_shr_r(Word32 L_var1, Word16 var2) | Long shift right with round |
| Word32 L_abs(Word32 L_var1) | Long abs |
| Word32 L_sat(Word32 L_var1) | Long saturation |
| Word16 norm_s(Word16 var1) | Short norm |
| Word16 div_s(Word16 var1, Word16 var2) | Short division |
| Word16 norm_l(Word32 L_var1) | Long norm |

TABLE 12

Summary of tables.

| File | Table name | Size | Description |
|---|---|---|---|
| tab_hup.c | tab_hup_s | 28 | upsampling filter for postfilter |
| tab_hup.c | tab_hup_l | 112 | upsampling filter for postfilter |
| inter_3.c | inter_3 | 13 | FIR filter for interpolating the correlation |
| pred_lt3.c | inter_3 | 31 | FIR filter for interpolating past excitation |
| lspcb.tab | lspcb1 | 128 × 10 | LSP quantizer (first stage) |
| lspcb.tab | lspcb2 | 32 × 10 | LSP quantizer (second stage) |
| lspcb.tab | fg | 2 × 4 × 10 | MA predictors in LSP VQ |
| lspcb.tab | fg_sum | 2 × 10 | used in LSP VQ |
| lspcb.tab | fg_sum_inv | 2 × 10 | used in LSP VQ |
| qua_gain.tab | gbk1 | 8 × 2 | codebook GA in gain VQ |
| qua_gain.tab | gbk2 | 16 × 2 | codebook GB in gain VQ |
| qua_gain.tab | map1 | 8 | used in gain VQ |
| qua_gain.tab | imap1 | 8 | used in gain VQ |
| qua_gain.tab | map2 | 16 | used in gain VQ |
| qua_gain.tab | ima21 | 16 | used in gain VQ |
| window.tab | window | 240 | LP analysis window |
| lag_wind.tab | lag_h | 10 | lag window for bandwidth expansion (high part) |
| lag_wind.tab | lag_l | 10 | lag window for bandwidth expansion (low part) |
| grid.tab | grid | 61 | grid points in LP to LSP conversion |
| inv_sqrt.tab | table | 49 | lookup table in inverse square root computation |
| log2.tab | table | 33 | lookup table in base 2 logarithm computation |
| lsp_lsf.tab | table | 65 | lookup table in LSF to LSP conversion and vice versa |
| lsp_lsf.tab | slope | 64 | line slopes in LSP to LSF conversion |
| pow2.tab | table | 33 | lookup table in $2^x$ computation |
| acelp.h | | | prototypes for fixed codebook search |
| ld8k.h | | | prototypes and constants |
| typedef.h | | | type definitions |

TABLE 13

Summary of encoder specific routines.

| Filename | Description |
|---|---|
| acelp_co.c | Search fixed codebook |
| autocorr.c | Compute autocorrelation for LP analysis |
| az_lsp.c | compute LSPs from LP coefficients |
| cod_ld8k.c | encoder routine |
| convolve.c | convolution operation |
| corr_xy2.c | compute correlation terms for gain quantization |
| enc_lag3.c | encode adaptive codebook index |
| g_pitch.c | compute adaptive codebook gain |
| gainpred.c | gain predictor |
| int_1pc.c | interpolation of LSP |
| inter_3.c | fractional delay interpolation |
| lag_wind.c | lag-windowing |
| levinson.c | levinson recursion |
| lspenc.c | LSP encoding routine |
| lspgetq.c | LSP quantizer |
| lspgett.c | compute LSP quantizer distortion |
| lspgetw.c | compute LSP weights |
| lsplast.c | select LSP MA predictor |
| lsppre.c | pre-selection first LSP codebook |
| lspprev.c | LSP predictor routines |
| lspsel1.c | first stage LSP quantizer |
| lspsel2.c | second stage LSP quautizer |
| lspstab.c | stability test for LSP quantizer |
| pitch_fr.c | closed-loop pitch search |
| pitch_ol.c | open-loop pitch search |
| pre_proc.c | pre-processing (HP filtering and scaling) |
| pwf.c | computation of perceptual weighting coefficients |
| qua_gain.c | gain quantizer |
| qua_lsp.c | LSP quantizer |
| relspwe.c | LSP quantizer |

TABLE 14

Summary of decoder specific routines.

| Filename | Description |
|---|---|
| d_lsp.c | decode LP information |
| de_acelp.c | decode algebraic codebook |
| dec_gain.c | decode gains |
| dec_lag3.c | decode adaptive codebook index |
| dec_ld8k.c | decoder routine |
| lspdec.c | LSP decoding routine |
| post_pro.c | post processing (HP filtering and scaling) |
| pred_lt3.c | generation of adaptive codebook |
| pst.c | postfilter routines |

TABLE 15

Summary of general routines.

| Filename | Description |
|---|---|
| basicop2.c | basic operators |
| bits.c | bit manipulation routines |
| gainpred.c | gain predictor |
| int_lpc.c | interpolation of LSP |
| inter_3.c | fractional delay interpolation |
| lsp_az.c | compute LP from LSP coefficients |
| lsp_lsf.c | conversion between LSP and LSF |
| lsp_lsf2.c | high precision conversion between LSP and LSF |
| lspexp.c | expansion of LSP coefficients |
| lspstab.c | stability test for LSP quantizer |
| p_parity.c | compute pitch parity |
| pred_lt3.c | generation of adaptive codebook |
| random.c | random generator |
| residu.c | compute residual signal |
| syn_filt.c | synthesis filter |
| weight_a.c | bandwidth expansion LP coefficients |

The invention claimed is:

1. A method for use in a speech processing system which includes a first portion comprising an adaptive codebook and corresponding adaptive codebook amplifier and a second portion comprising a fixed codebook coupled to a pitch filter, the pitch filter comprising a delay memory coupled to a pitch filter amplifier, the method comprising:

determining the pitch filter gain based on a measure of periodicity of a speech signal; and amplifying samples of a signal in said pitch filter based on said determined pitch filter gain.

2. The method of claim 1 wherein the adaptive codebook gain is delayed for one subframe.

3. The method of claim 1 where the signal reflecting the adaptive codebook gain is delayed in time.

4. The method of claim 1 wherein the signal reflecting the adaptive codebook gain comprises values which are greater than or equal to a lower limit and less than or equal to an upper limit.

5. The method of claim 1 wherein the speech signal comprises a speech signal being encoded.

6. The method of claim 1 wherein the speech signal comprises a speech signal being synthesized.

7. A speech processing system comprising:

a first portion including an adaptive codebook and means for applying an adaptive codebook gain, and a second portion including a fixed codebook, a pitch filter, wherein the pitch filter includes a means for applying a pitch filter gain, and wherein the improvement comprises:

means for determining said pitch filter gain, based on a measure of periodicity of a speech signal.

8. The speech processing system of claim 7 wherein the signal reflecting the adaptive codebook gain is delayed for one subframe.

9. The speech processing system of claim 7 wherein the pitch filter gain equals a delayed adaptive codebook gain.

10. The speech processing of claim 7 wherein the pitch filter gain is limited to a range of values greater than or equal to 0.2 and less than or equal to 0.8 and, within said range, comprises a delayed adaptive codebook gain.

11. The speech processing system of claim 7 wherein the signal reflecting the adaptive codebook gain is limited to a range of values greater than or equal to 0.2 and less than or equal to 0.8 and, within said range, comprises an adaptive codebook gain.

12. The speech processing system of claim 7 wherein said first and second portions generate first and second output signals and wherein the system further comprises:

means for summing the first .and second output signals; and a linear prediction filter, coupled the means for summing, for generating a speech signal in response to the summed first and second signals.

13. The speech processing system of claim 12 further comprising a post filter for filtering said speech signal generated by said linear prediction filter.

14. The speech processing system of claim 7 wherein the speech processing system is used in a speech encoder.

15. The speech processing system of claim 7 wherein the speech processing system is used in aspeech decoder.

16. The speech processing system of claim 5 wherein the means for determining comprises a memory for delaying a signal reflecting the adaptive codebook gain used in said first portion.

17. A method for determining a gain of a pitch filter for use in a speech processing system, the system including a first portion comprising an adaptive codebook and corresponding adaptive codebook amplifier and a second portion comprising a fixed codebook coupled to a pitch filter, the pitch filter comprising a delay memory coupled to a pitch filter amplifier for applying said determined gain, the speech processing system for processing a speech signal, the method comprising:

determining the pitch filter gain based on periodicity of the speech signal.

18. A method for use in a speech processing system which includes a first portion which comprises an adaptive codebook and corresponding adaptive codebook amplifier and a second portion which comprises a fixed codebook coupled to a pitch filter, the pitch filter. comprising a delay memory coupled to a pitch filter amplifier, the method comprising:

delaying the adaptive codebook gain;

determining the pitch filter gain to be equal to the delayed adaptive codebook gain, except when the adaptive codebook gain is either less than 0.2 or greater than 0.8., in which cases the pitch filter gain is set equal to 0.2 or 0.8, respectively; and amplifying samples of a signal in said pitch filter based on said determined pitch filter gain.

19. A speech processing system comprising:

a first portion including an adaptive codebook and means for applying an adaptive codebook gain, and a second portion including a fixed codebook, a pitch filter, means for applying a second gain, wherein the pitch filter includes a means for applying a pitch filter gain, and wherein the improvement comprises:

means for determining said pitch filter gain, said means for determining including means for setting the pitch filter gain equal to an adaptive codebook gain, said signal gain is either less than 0.2 or greater than 0.8., in which cases-the pitch filter gain is set equal to 0.2 or 0.8, respectively.

* * * * *

US005664055C1

(12) EX PARTE REEXAMINATION CERTIFICATE (8493rd)

United States Patent

Kroon

(10) Number: US 5,664,055 C1

(45) Certificate Issued: Aug. 30, 2011

(54) CS-ACELP SPEECH COMPRESSION SYSTEM WITH ADAPTIVE PITCH PREDICTION FILTER GAIN BASED ON A MEASURE OF PERIODICITY

(75) Inventor: Peter Kroon, Green Grook, NJ (US)

(73) Assignee: Research in Motion Limited, Waterloo (CA)

Reexamination Request:
No. 90/010,582, Jun. 22, 2009

Reexamination Certificate for:

| | |
|---|---|
| Patent No.: | **5,664,055** |
| Issued: | **Sep. 2, 1997** |
| Appl. No.: | **08/482,715** |
| Filed: | **Jun. 7, 1995** |

(51) Int. Cl.

| | |
|---|---|
| ***G10L 19/08*** | (2006.01) |
| ***G10L 19/00*** | (2006.01) |
| ***G10L 11/04*** | (2006.01) |
| ***G10L 11/00*** | (2006.01) |

(52) U.S. Cl. ..... 704/223; 704/208; 704/219; 704/220; 704/222; 704/E19.027

(58) Field of Classification Search ..... None
See application file for complete search history.

(56) References Cited

U.S. PATENT DOCUMENTS

| | | | |
|---|---|---|---|
| 4,969,192 | A | 11/1990 | Chen et al. |
| 4,980,916 | A | 12/1990 | Zinser |
| 5,007,092 | A | 4/1991 | Galand et al. |
| 5,127,053 | A | 6/1992 | Koch |
| 5,199,076 | A | 3/1993 | Taniguchi et al. |
| 5,245,662 | A | 9/1993 | Taniguchi et al. |
| 5,261,027 | A | 11/1993 | Taniguchi et al. |
| 5,323,486 | A | 6/1994 | Taniguchi et al. |
| 5,339,384 | A | 8/1994 | Chen |
| 5,359,696 | A | 10/1994 | Gerson et al. |
| 5,396,576 | A | 3/1995 | Miki et al. |
| 5,528,727 | A | 6/1996 | Wang |
| 5,602,961 | A | 2/1997 | Kolesnik et al. |
| 5,657,418 | A | 8/1997 | Gerson et al. |
| 5,717,823 | A | 2/1998 | Kleijn |
| 5,719,993 | A | 2/1998 | Kleijn |
| 5,745,871 | A | 4/1998 | Chen |
| 5,862,518 | A | 1/1999 | Nomura et al. |

FOREIGN PATENT DOCUMENTS

| | | |
|---|---|---|
| CA | 2124713 | 6/1993 |
| EP | 0 514 912 | 11/1992 |
| EP | 0 623 916 B1 | 7/1999 |
| WO | WO 93/15503 | 8/1993 |

OTHER PUBLICATIONS

Redwan Salami, et al., A Toll Quality 8 kb/s Speech Codec for the Personal Communications System (PCS), IEEE Transactions on Vehicular Technology, vol. 43, No. 3, pp. 808–816 (Aug. 1994) ("Salami").

(Continued)

*Primary Examiner*—Charles Craver

(57) ABSTRACT

A speech coding system employing an adaptive codebook model of periodicity is augmented with a pitch-predictive filter (PPF). This PPF has a delay equal to the integer component of the pitch-period and a gain which is adaptive based on a measure of periodicity of the speech signal. In accordance with an embodiment of the present invention, speech processing systems which include a first portion comprising an adaptive codebook and corresponding adaptive codebook amplifier and a second portion comprising a fixed codebook coupled to a pitch filter, are adapted to delay the adaptive codebook gain; determine the pitch filter gain based on the delayed adaptive codebook gain, and amplify samples of a signal in the pitch filter based on said determined pitch filter gain. The adaptive codebook gain is delayed for one subframe. The pitch filter gain equals the delayed, adaptive codebook gain, except when the adaptive codebook gain is either less than 0.2 or greater than 0.8., in which cases the pitch filter gain is set equal to 0.2 or 0.8, respectively.

AMENDED

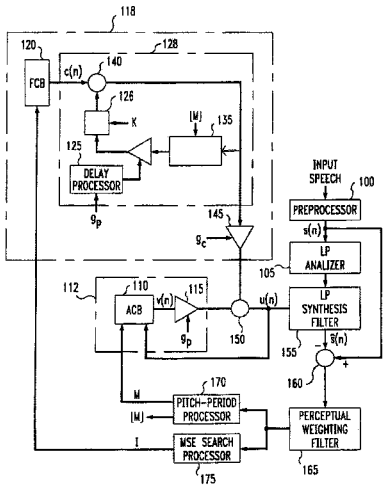

OTHER PUBLICATIONS

Allen Gerhso, "Advances in Speech and Audio Compression," Proceedings of the IEEE, vol. 82, No. 6, Jun. 1994 (19 pages).
Gerson et al., "Vector Sum Excited Linear Prediction (VSELP) Speech Coding at 4.8 kbps," International Mobile Satellite Conference, Ottawa, 1990 (6 pages).
Gerson et al., "Techniques for Improving the Performance of CELP–Type Speech Coders," IEEE Journal on Selected Areas In Communications, vol. 10, No. 5, Jun. 1992 (8 pages).
Akamine et al., "Improvement of ADP–CELP Speech Coding at 4 Kbits/s," IEEE 1991 (5 pages).
P. Kabal ,"Code Excited Linear Prediction Coding of Speech at 4.8 kb/s," INRS—Télécommunications No. 87–36, Jul. 1987 (18 pages).
Kleijn et al., "An Efficient Stochastically Excited Linear Predictive Coding Algorithm for High Quality Low Bit Rate Transmission of Speech," Speech Communication 7, 1998 (12 pages).
Menez et al., "Adaptive Code Excited Linear Predictive Coder (ACELPC)," IEEE, 1989 (4 pages).
Hermansson et al., "A Speech Codec for Cellular Radio at a Gross Bit Rate of 11.4 kb/s," IEEE, 1991. (4 pages).
Taniguchi et al., "Pitch Sharpening for Perceptually Improved CELP, and the Sparse–Delta Codebook for Reduced Computation," IEEE, 1991 (4 pages).
Wang et al., "Improved Excitation for Phonetically–Segmented VXC Speech Coding Below 4 Kb/s," IEEE, 1990 (5 pages).
Miki et al., "Pitch Synchronous Innovation CELP (PSI–CELP)," Third European Conference on Speech Communication and Technology, Sep. 22–25, 1993 (4 pages).
Kroon et al., "Linear–Prediction based Analysis–by–Synthesis Coding," Speech Coding and Synthesis, 1995 (41 pages).
Defendant Motorola, Inc.'s Answer and Counterclaims; Demand for Jury Trial filed Jan. 9, 2009 from *Research in Motion Limited, Research in Motion Corporation, and TIP Communications, LLC* v. *Motorola, Inc.* Civil Action No. 3:08–CV–0284–G (N.D. Tex).
Motorola, Inc.'s First Supplemental Responses to First Set of Interrogatories (No. 14) filed Jun. 12, 2009 from *Research in Motion Limited Research in Motion Corporation, and TIP Communications, LLC* v. *Motorola, Inc.* Civil Action No. 3:08–CV–0284–G (N.D. Tex.).
Motorola, Inc.'s First Supplemental Responses to First Set of Interrogatories (No. 14) Exhibit B filed Jun. 12, 2009 from *Research in Motion Limited, Research in Motion Corporation, and TIP Communications, LLC* v. *Motorola, Inc.* Civil Action No. 3:08–CV–0284–G (N.D. Tex.).
Defendant Motorola Inc.'s First Amended Counterclaims; Demand for Jury Trial filed Oct. 14, 2009 from *Research in Motion Limited, Research in Motion Corporation, and TIP Communications, LLC* v. *Motorola Inc.* Civil Action No. 3:08–CV–0284–G (N.D. Tex.).

*FIG. 3* AMENDED
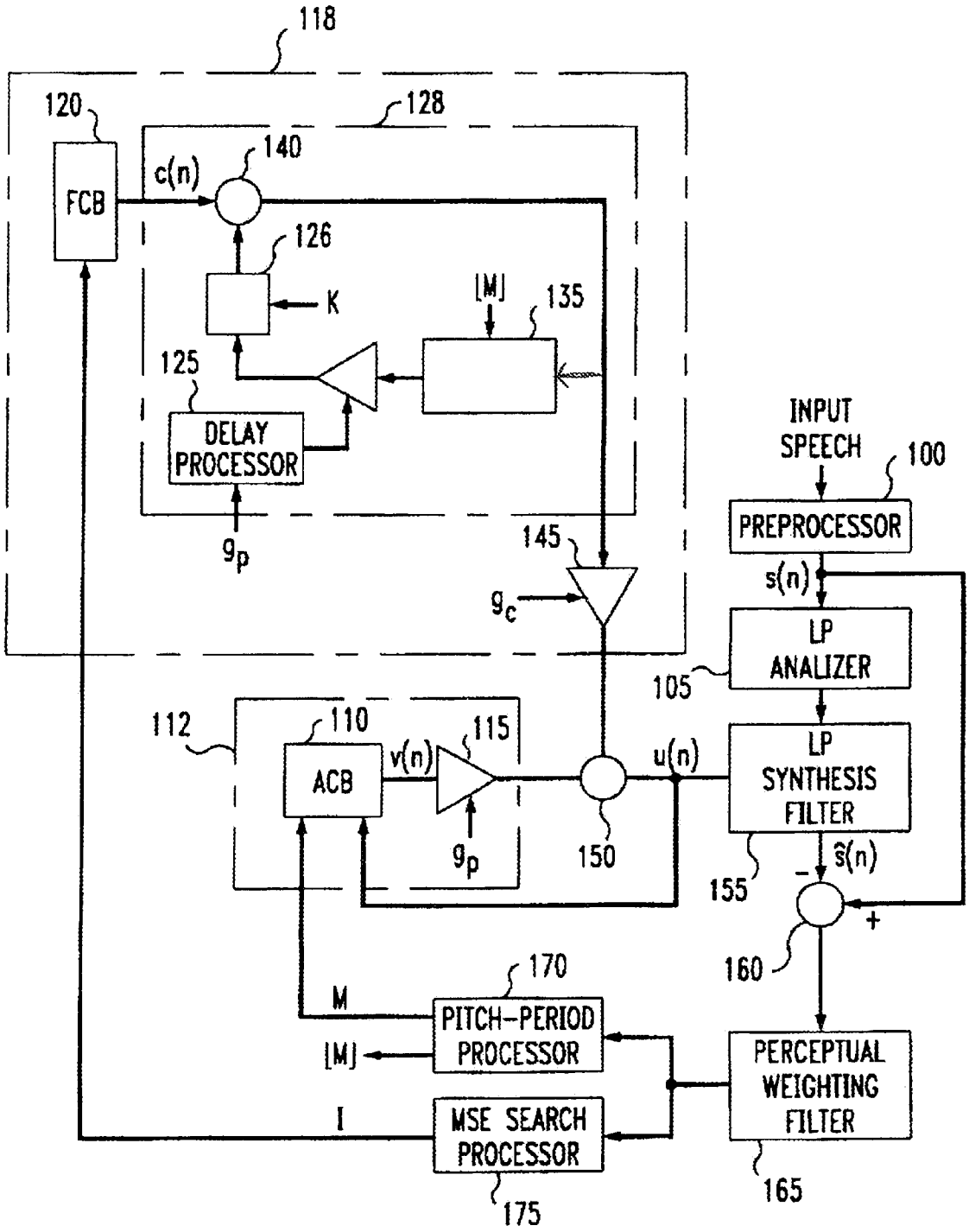

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

THE DRAWING FIGURES HAVE BEEN CHANGED AS FOLLOWS:

FIG. 3 has added line into box 135.

AS A RESULT OF REEXAMINATION, IT HAS BEEN DETERMINED THAT:

Claims 1, 7 and 17 are cancelled.

Claims 2-6, 8-12, 14-16, 18 and 19 are determined to be patentable as amended.

Claim 13, dependent on an amended claim, is determined to be patentable.

New claims 20-59 are added and determined to be patentable.

2. [The method of claim 1] *A method for use in a speech processing system which includes a first portion comprising an adaptive codebook and a corresponding adaptive codebook amplifier and a second portion comprising a fixed codebook coupled to a pitch filter, the pitch filter comprising a delay memory coupled to a pitch filter amplifier, the method comprising:*

*determining a pitch filter gain based on a measure of periodicity of a speech signal; and*

*amplifying samples of a signal in said pitch filter based on said determined pitch filter gain,* wherein [the] *an* adaptive codebook gain is delayed for one subframe.

3. [The method of claim 1] *A method for use in a speech processing system which includes a first portion comprising an adaptive codebook and a corresponding adaptive codebook amplifier and a second portion comprising a fixed codebook coupled to a pitch filter, the pitch filter comprising a delay memory coupled to a pitch filter amplifier, the method comprising:*

*determining a pitch filter gain based on a measure of periodicity of a speech signal; and*

*amplifying samples of a signal in said pitch filter based on said determined pitch filter gain,* [where the signal reflecting the] *wherein the pitch filter gain equals a delayed* adaptive codebook gain [is delayed in time].

4. [The method of claim 1] *A method for use in a speech processing system which includes a first portion comprising an adaptive codebook and a corresponding adaptive codebook amplifier and a second portion comprising a fixed codebook coupled to a pitch filter, the pitch filter comprising a delay memory coupled to a pitch filter amplifier, the method comprising:*

*determining a pitch filter gain based on a measure of periodicity of a speech signal; and*

*amplifying samples of a signal in said pitch filter based on said determined pitch filter gain,* wherein the [signal reflecting the adaptive codebook gain comprises values which are greater than or equal to a lower limit and less than or equal to an upper limit] *pitch filter gain is limited to a range of values greater than or equal to 0.2 and less than or equal to 0.8 and, within said range, comprises an adaptive codebook gain.*

5. The method of [claim 1] *any one of claims 2-4* wherein the speech signal comprises a speech signal being encoded.

6. The method of [claim 1] *any one of claims 2-4* wherein the speech signal comprises a speech signal being synthesized.

8. [The speech processing system of claim 7] *A speech processing system comprising:*

*a first portion including an adaptive codebook and means for applying an adaptive codebook gain, and*

*a second portion including a fixed codebook, a pitch filter, wherein the pitch filter includes a means for applying a pitch filter gain,*

*and wherein the improvement comprises:*

*means for determining said pitch filter gain, based on a measure of periodicity of a speech signal,* wherein [the] *a* signal reflecting the adaptive codebook gain is delayed for one subframe.

9. [The speech processing system of claim 7] *A speech processing system comprising:*

*a first portion including an adaptive codebook and means for applying an adaptive codebook gain, and*

*a second portion including a fixed codebook, a pitch filter, wherein the pitch filter includes a means for applying a pitch filter gain,*

*and wherein the improvement comprises:*

*means for determining said pitch filter gain, based on a measure of periodicity of a speech signal,* wherein the pitch filter gain equals a delayed adaptvie codebook gain.

10. [The speech processing system of claim 7] *A speech processing system comprising:*

*a first portion including an adaptive codebook and means for applying an adaptive codebook gain, and*

*a second portion including a fixed codebook, a pitch filter, wherein the pitch filter includes a means for applying a pitch filter gain,*

*and wherein the improvement comprises:*

*means for determining said pitch filter gain, based on a measure of periodicity of a speech signal,* wherein the pitch filter gain is limited to a range of values greater than or equal to 0.2 and less than or equal to 0.8 and, within said range, comprises a delayed adaptive codebook gain.

11. [The speech processing system of claim 7] *A speech processing system comprising:*

*a first portion including an adaptive codebook and means for applying an adaptive codebook gain, and*

*a second portion including a fixed codebook, a pitch filter, wherein the pitch filter includes a means for applying a pitch filter gain,*

*and wherein the improvement comprises:*

*means for determining said pitch filter gain, based on a measure of periodicity of a speech signal,* wherein the [signal reflecting the] *pitch filter gain is equal to an* adaptive codebook gain *when the adaptive codebook gain is in a range of values greater than or equal to 0.2 and less than or equal to 0.8 and when the adap-*

*tive codebook value is outside that range, the pitch filter gain* is limited to a range of values greater than or equal to 0.2 and less than or equal to 0.8 [and, within said range, comprises an adaptive codebook gain].

12. The speech processing system of [claim 7] *any one of claims 8-11* wherein said first and second portions generate first and second output signals and wherein the system further comprises:

means for summing the first [.]and second output signals; and a linear prediction filter, coupled *to* the means for summing, for generating a speech signal in response to the summed first and second signals.

14. The speech processing system of [claim 7] *any one of claims 8-11* wherein the speech processing system is used in a speech encoder.

15. The speech processing system of [claim 7] *any one of claims 8-11* wherein the speech processing system is used in [aspeech] *a speech* decoder.

16. The speech processing system of [claim 5] *any one of claims 8-11* wherein the means for determining comprises a memory for delaying a signal reflecting the adaptive codebook gain used in said first portion.

18. A method for use in a speech processing system which includes a first portion which comprises an adaptive codebook and *a* corresponding adaptive codebook amplifier and a second portion which comprises a fixed codebook coupled to a pitch filter, the pitch filter[.] comprising a delay memory coupled to a pitch filter amplifer, the method comprising:

delaying [the] *an* adpative codebook gain;

determining [the] *a* pitch filter gain to be equal to the delayed adaptive codebook gain, except when the adaptive codebook gain is either less than 0.2 or greater than 0.8 [.], in which cases the pitch filter gain is set equal to 0.2 or 0.8, respectively; and amplifying samples of a signal in said pitch filter based on said determined pitch filter gain.

19. A speech processing system comprising:

a first portion including an adaptive codebook and means for applying an adaptive codebook gain, and a second portion including a fixed codebook, a pitch filter, and means for applying a second gain, wherein the pitch filter includes a means for applying a pitch filter gain, and wherein the improvement comprises:

means for determining said pitch filter gain, said means for determining including means for setting the pitch filter gain equal to an adaptive codebook gain, *and when* said [signal] *adaptive codebook* gain is either less than 0.2 or greater than 0.8, [in which cases-] the filter gain is set equal to 0.2 or 0.8, respectively.

*20. A method for use in a speech processing system which includes a first portion comprising an adaptive codebook and a corresponding adaptive codebook amplifier and a second portion comprising a fixed codebook coupled to a pitch filter, the pitch filter comprising a delay memory coupled to a pitch filter amplifier, the method comprising:*

*determining a pitch filter gain based on a measure of a periodicity of a speech signal; and*

*amplifying samples of a signal in said pitch filter based on said determined pitch filter gain, wherein the pitch filter does not vary in operation from sample to sample within a subframe and adds a fixed codebook contribution and a pitch contribution to produce a filtered fixed codebook contribution, wherein the fixed codebook contribution is not modified prior to being added to the pitch contribution.*

*21. A method for determining a gain of a pitch filter for use in a speech processing system, the speech processing system receiving a speech signal and employing frames and subframes representing durations of speech, the system including:*

*a first portion comprising an adaptive codebook and a corresponding adaptive codebook amplifier; and*

*a second portion comprising a fixed codebook coupled to a pitch filter, wherein the pitch filter does not vary in operation from sample to sample within a subframe and comprises a delay memory coupled to a pitch filter amplifier for selectively applying a determined pitch filter gain, and the determined pitch filter gain is applied depending upon a predetermined relationship existing between a pitch period of a speech signal and a subframe conveying the speech signal,*

*the speech processing system for processing the speech signal, the method comprising:*

*determining the pitch filter gain based on a measure of periodicity of the speech signal.*

*22. The method of claim 21, wherein the relationship is the pitch period being less than the subframe.*

*23. A method for determining a gain of a pitch filter for use in a speech processing system, the system including:*

*a first portion comprising an adaptive codebook and a corresponding adaptive codebook amplifier characterized by an adaptive codebook gain; and*

*a second portion comprising a fixed codebook coupled to a pitch filter, wherein said pitch filter does not vary in operation from sample to sample within a subframe,*

*the speech processing system for processing a speech signal, the method comprising:*

*determining the pitch filter gain based on periodicity of the speech signal and the pitch filter is limited to be less than a highest value of the adaptive codebook gain.*

*24. The method of claim 23, wherein said pitch filter gain is a delayed version of the adaptive codebook gain.*

*25. The method of claim 23, wherein said pitch filter gain is further limited to be greater than a predetermined value.*

*26. The method of claim 23, wherein the highest value of said pitch filter gain is 0.8.*

*27. The method of claim 23, wherein the highest value of said pitch filter gain is less than 1.0.*

*28. A method for determining a gain of a pitch filter for use in a speech processing system, the system including:*

*a first portion comprising an adaptive codebook and a corresponding adaptive codebook amplifier characterized by an adaptive codebook gain; and*

*a second portion comprising a fixed codebook coupled to a pitch filter, wherein the pitch filter does not vary in operation from sample to sample within a subframe,*

*the speech processing system for processing a speech signal, the method comprising:*

*determining the pitch filter gain based on a measure of periodicity of the speech signal and the ptich filter gain is limited to be greater than zero.*

*29. The method of claim 28, wherein said pitch filter gain is a delayed version of the adaptive codebook gain.*

*30. The method of claim 28, wherein said pitch filter gain is further limited to be greater than or equal to a predetermined value greater than zero.*

*31. The method of claim 30, wherein said pitch filter gain is limited to be greater than or equal to 0.2.*

*32. The method of claim 28, wherein said pitch filter gain is further limited to be less than or equal to a predetermined value.*

*33. The method of claim 32, wherein said pitch filter gain is limited to be less than or equal to 0.9.*

*34. A speech processing system comprising:*

*a first portion including an adaptive codebook and means for applying an adaptive codebook gain, and*

*a second portion including a fixed codebook, a pitch filter, wherein the pitch filter includes a means for applying a pitch filter gain,*

*and wherein the improvement comprises:*

*means for determining said pitch filter gain, based on a measure of periodicity of a speech signal,*

*wherein said pitch filter does not vary in operation from sample to sample within a subframe and wherein the determining means consists essentially of a delay means and means for limiting the range of the pitch filter gain.*

*35. A method for use in a speech processing system which includes a first portion comprising an adaptive codebook and a corresponding adaptive codebook amplifier and a second portion comprising a fixed codebook coupled to a pitch filter, the pitch filter comprising a delay memory coupled to a pitch filter amplifier, the method comprising:*

*determining a pitch filter gain based on a measure of periodicity of a speech signal; and*

*amplifying samples of a signal in said pitch filter based on said determined pitch filter gain, wherein said pitch filter does not vary in operation from sample to sample within a subframe and wherein said pitch filter is employed only when a pitch period is less than a subframe.*

*36. A method for determining a gain of a pitch filter for use in a speech processing system, the system including a first portion comprising an adaptive codebook and a corresponding adaptive codebook amplifier and a second portion comprising a fixed codebook coupled to a pitch filter, the pitch filter comprising a delay memory coupled to a pitch filter amplifier for applying a determined gain, the speech processing system for processing a speech signal, the method comprising:*

*determining the pitch filter gain based on periodicity of the speech signal,*

*wherein said pitch filter does not vary in operation from sample to sample within a subframe and wherein said pitch filter is employed only when a pitch period is less than a subframe.*

*37. The method of claim 18, wherein said pitch filter does not vary in operation from sample to sample within a subframe and wherein said pitch filter is employed only when a pitch period is less than a subframe.*

*38. The system of claim 19, wherein said pitch filter does not vary in operation from sample to sample within a subframe and wherein the system including means for coupling said pitch filter to said fixed codebook only when a pitch period is less than a subframe.*

*39. A speech processing system comprising:*

*a first portion including an adaptive codebook and means for applying an adaptive codebook gain, and*

*a second portion including a fixed codebook, a pitch filter, wherein the pitch filter includes a means for applying a pitch filter gain,*

*and wherein the improvement comprises:*

*means for determining said pitch filter gain, based on a measure of periodicity of a speech signal, wherein said pitch filter does not vary in operation from sample to sample within a subframe;*

*said means for applying an adaptive codebook gain comprises an adaptive codebook amplifier coupled to receive an adaptive codebook amplifier gain determined by a measure of periodicity of a speech signal;*

*said means for applying a pitch filter gain comprises a pitch filter amplifier;*

*said means for determining said pitch filter gain comprises a delay memory coupled to receive said adaptive codebook amplifier gain; and*

*said speech processing system further includes a switch connected to include said pitch filter in said system when a pitch period is less than a subframe and to exclude said pitch filter from said system when the pitch period is greater than or equal to the subframe.*

*40. A method for use in a speech processing system which includes a first portion comprising an adaptive codebook and a corresponding adaptive codebook amplifier and a second portion comprising a fixed codebook coupled to a pitch filter, the pitch filter comprising a delay memory coupled to a pitch filter amplifier, the method comprising:*

*determining a pitch filter gain based on a measure of periodicity of a speech signal; and*

*amplifying samples of a signal in said pitch filter based on said determined pitch filter gain, wherein said pitch filter does not vary in operation from sample to sample within a subframe, said adaptive codebook amplifier has an adaptive codebook gain, said adaptive codebook gain is delayed for one subframe, and said pitch filter gain is based on said delayed adaptive codebook gain.*

*41. A method for use in a speech processing system which includes a first portion comprising an adaptive codebook and a corresponding adaptive codebook amplifier and a second portion comprising a fixed codebook coupled to a pitch filter, the pitch filter comprising a delay memory coupled to a pitch filter amplifier, the method comprising:*

*determining a pitch filter gain based on a measure of periodicity of a speech signal; and*

*amplifying samples of a signal in said pitch filter based on said determined pitch filter gain, wherein said pitch filter does not vary in operation from sample to sample within a subframe and said pitch filter gain is limited to a range of values less than 1.0 and, within said range, is based on a delayed adaptive codebook gain.*

*42. The method of claim 41 wherein the highest value of said pitch filter gain is 0.8.*

*43. The method of claim 2 wherein said pitch filter does not vary in operation from sample to sample within a subframe and said pitch filter gain is limited to a range of values less than 1.0 and, within said range, is based on the delayed adaptive codebook gain.*

*44. The method of claim 43 wherein the highest value of said pitch filter gain is 0.8.*

*45. A method for use in a speech processing system which includes a first portion comprising an adaptive codebook and a corresponding adaptive codebook amplifier having a corresponding adaptive codebook gain and a second portion comprising a fixed codebook coupled to a pitch filter that does not vary in operation from sample to sample within a subframe and comprises a delay memory coupled to a pitch filter amplifier, the method comprising:*

*determining a pitch filter gain based on a measure of periodicity of a speech signal; and*

*amplifying samples of a signal in said pitch filter based on said determined pitch filter gain.*

*46. A method for use in a speech processing system which includes a first portion comprising an adaptive codebook and a corresponding adaptive codebook amplifier having a corresponding adaptive codebook gain and a second portion comprising a fixed codebook coupled to a pitch filter, the pitch filter comprising a delay memory coupled to a pitch filter amplifier, wherein the speech processing system receives a speech signal and generates frames and subframes representing durations of speech, the method comprising:*

*determining a pitch filter gain based on a measure of periodicity of a speech signal for a subframe; and*

*amplifying samples of a signal in said pitch filter based on said determined pitch filter gain, wherein the operation of said pitch filter is uniform for all samples of the subframe.*

*47. The method of claim 46 wherein the operation of said pitch filter is independent of the pitch period within any subframe and said pitch filter is employed only for subframes when the pitch period is less than the subframe.*

*48. A method for determining a gain of a pitch filter for use in a speech processing system, the system including:*

*a first portion comprising an adaptive codebook and a corresponding adaptive codebook amplifier characterized by an adaptive codebook gain; and*

*a second portion comprising a fixed codebook coupled to a pitch filter, wherein said pitch filter does not vary in operation from sample to sample within a subframe,*

*the speech processing system for processing a speech signal, the method comprising:*

*determining the pitch filter gain based on the adaptive codebook gain which in turn is based on periodicity of the speech signal, and the pitch filter gain is limited to be less than a highest value of the adaptive codebook gain.*

*49. A method for determining a gain of a pitch filter for use in a speech processing system, the system including:*

*a first portion comprising an adaptive codebook and a corresponding adaptive codebook amplifier characterized by an adaptive codebook gain; and*

*a second poriton comprising a fixed codebook coupled to a pitch filter, wherein the pitch filter does not vary in operation from sampel to sample within a subframe,*

*the speech processing system for processing a speech signal, the method comprising:*

*determining the pitch filter gain based on the adaptive codebook gain which in turn is based on periodicity of the speech signal, and the pitch filter gain is limited to be greater than zero.*

*50. A method for use in a speech processing system which includes a first portion comprising an adaptive codebook and a corresponding adaptive codebook amplifier having a corresponding adaptive codebook gain and a second portion comprising a fixed codebook coupled to a pitch filter that does not vary in operation from sample to sample within a subframe and comprises a delay memory coupled to a pitch filter amplifier, the method comprising:*

*determining a pitch filter gain based on the adaptive codebook gain delayed for one subframe; and*

*amplifying samples of a signal in said pitch filter based on said determined pitch filter gain.*

*51. The method of claim 48, wherein said pitch filter gain is a delayed version of the adaptive codebook gain.*

*52. The method of claim 48, wherein said pitch filter gain is further limited to be greater than a predetermined value.*

*53. The method of claim 48, wherein the highest value of said pitch filter gain is 0.8.*

*54. The method of claim 48, wherein the highest value of said pitch filter gain is less than 1.0.*

*55. The method of claim 49, wherein said pitch filter gain is a delayed version of the adaptive codebook gain.*

*56. The method of claim 49, wherein said pitch filter gain is further limited to be greater than or equal to a predetermined value greater than zero.*

*57. The method of claim 56, wherein said pitch filter gain is limited to be greater than or equal to 0.2.*

*58. The method of claim 49, wherein said pitch filter gain is further limited to be less than or equal to a predetermined value.*

*59. The method of claim 58, wherein said pitch filter gain is limited to be less than or equal to 0.9.*

* * * * *